US008763416B2

(12) United States Patent
Hika et al.

(10) Patent No.: US 8,763,416 B2
(45) Date of Patent: Jul. 1, 2014

(54) OUTDOOR UNIT OF AIR CONDITIONER

(75) Inventors: Yasushi Hika, Kawasaki (JP); Yoshinori Hiramatsu, Kawasaki (JP); Mitsuo Ueda, Kawasaki (JP); Yasumasa Tsuji, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 175 days.

(21) Appl. No.: 13/361,246

(22) Filed: Jan. 30, 2012

(65) Prior Publication Data

US 2012/0192585 A1 Aug. 2, 2012

(30) Foreign Application Priority Data

Jan. 31, 2011 (JP) ..... 2011-018325

(51) Int. Cl.
*F25D 19/00* (2006.01)

(52) U.S. Cl.
USPC ..... 62/298; 312/100; 52/27

(58) Field of Classification Search
USPC ..... 62/77, 259.2, 298, 507, 452, 454, 455, 62/428; 108/157.15, 157.1, 57.25; 312/100; 52/27
See application file for complete search history.

(56) References Cited

U.S. PATENT DOCUMENTS 1,713,661 A * 5/1929 Kemball et al. ..... 312/117
2007/0163295 A1 * 7/2007 Martin et al. ..... 62/507

FOREIGN PATENT DOCUMENTS

JP 1 991 01 258 * 5/1991
JP 20060258364 A * 9/2006
JP 2010007970 A * 1/2010

* cited by examiner

*Primary Examiner* — Cheryl J Tyler
*Assistant Examiner* — Orlando E Aviles Bosques
(74) *Attorney, Agent, or Firm* — Manabu Kanesaka

(57) ABSTRACT

An outdoor unit of an air conditioner for facilitating setting of an electrical component box into the outdoor unit. A blower chamber side of a box base plate is similar in shape to a lower partition plate provided with a receiving part formed by bending inward an upper end of the lower partition plate. When joining an electrical component box to the lower partition plate, the box base plate is set onto the receiving part along a flange, whereby positioning the electrical component box, which is fixed to the lower partition plate by fastening with a screw, welding, or other suitable method. The positioning can be achieved only by putting the box on the receiving part along the flange. Facilitated positioning and fixing leads to simplicity and enhanced workability.

6 Claims, 18 Drawing Sheets

OUTDOOR UNIT OF AIR CONDITIONER

CROSS-REFERENCE TO RELATED APPLICATIONS

The present application is based on, and claims priority from, Japanese Application Serial Number JP2011-18325, filed Jan. 31, 2011, the disclosure of which is hereby incorporated by reference herein in its entirety.

TECHNICAL FIELD

The present invention relates to an outdoor unit of an air conditioner, and more particularly, to a method of setting an electrical component box into an outdoor unit.

BACKGROUND ART

Conventionally, an air conditioner installed in a building such as a condominium or an ordinary house includes: an outdoor unit installed outside of the building; and an indoor unit installed on a ceiling or a wall surface inside of the building. It is known that the outdoor unit is connected to the indoor unit by refrigerant piping. The inside of the outdoor unit is divided by a partition plate attached to a bottom plate constituting part of a casing of the outdoor unit, into a blower chamber in which a heat exchanger, a blower fan, and the like are installed and a machinery chamber in which a compressor, an accumulator, and the like are provided. An electrical component box is placed above the machinery chamber, and the electrical component box includes: a power supply apparatus that supplies driving electric power to apparatuses such as the compressor and the blower fan provided in the outdoor unit; and a control board that controls the operation of the outdoor unit.

For example, Japanese Patent Application Publication No. 2010-7970 describes a partition plate that is divided into a lower partition plate and an upper partition plate constituting part of a casing of an electrical component box. The casing of the electrical component box is formed of: the upper partition plate; a front plate that is made of a steel plate formed into a substantially U-shape as viewed from the top; and a member that is made of a steel plate formed into a substantially L-shape as viewed from the top and covers the back side and one side of the electrical component box, the one side being opposed to the upper partition plate. Then, the upper partition plate and the front plate have, attached thereto: various boards on which a heater element is mounted, such as a control board and an inverter board; and heat generating components such as a power module, a reactor, and a terminal mount.

In the electrical component box described in Japanese Patent Application Publication No. 2010-7970, the shape of the upper partition plate is similar to the shape of the lower partition plate, and a fixing part that is substantially U-shaped in cross-section is provided at the lower end part of the upper partition plate such that the leading end part of the lower partition plate can be inserted thereinto. At the time of setting the electrical component box to the machinery chamber of the outdoor unit, the leading end part of the lower partition plate is inserted into the fixing part of the upper partition plate, whereby the electrical component box is put on the lower partition plate. In this state, the upper partition plate and the lower partition plate are joined to each other by screwing or welding, whereby the electrical component box is fixed to the machinery chamber.

According to the above-mentioned method of setting the electrical component box, the electrical component box needs to be supported in an extremely small area (only the thickness of the lower partition plate and a portion thereof to be inserted into the fixing part of the upper partition plate) of the leading end part of the lower partition plate. Because the electrical component box is generally heavy (approximately 10 kg), if the electrical component box is supported in such a small area of the lower partition plate, the electrical component box may be unstable while being put on the lower partition plate. Hence, it is necessary to keep holding the electrical component box until the two partition plates are joined to each other by screwing or welding, resulting in decrease in workability.

The present invention has been made in order to solve the above-mentioned problem, and therefore has an object to provide an outdoor unit of an air conditioner capable of facilitating setting work of an electrical component box into the outdoor unit.

SUMMARY OF THE INVENTION

In order to solve the above-mentioned problem, an outdoor unit of an air conditioner according to the present invention has a main body the inside of which is divided by a partition plate extending between a bottom plate and a top plate, into a blower chamber housing therein a heat exchanger and a blower fan and a machinery chamber housing therein a compressor and an electrical component box. The partition plate includes an upper partition plate and a lower partition plate. The electrical component box includes: the upper partition plate; a front plate that covers a front side of the electrical component box; and a box base plate that receives the upper partition plate and the front plate and is fixed to the lower partition plate. The box base plate is provided with a flange in a periphery thereof, the flange being bent downward. Part of the flange is shaped so as to be engaged with an upper end surface of the lower partition plate. The electrical component box is set to the machinery chamber such that the part of the flange is fitted to the lower partition plate.

Further, the lower partition plate includes a receiving part formed on the upper end surface thereof, the receiving part receiving the box base plate.

In the electrical component box thus configured of the outdoor unit according to the present invention, the box base plate is provided, in the periphery thereof, with the flange that is shaped so as to be similar to the shape of the upper end surface of the lower partition plate, and the box base plate is positioned with respect to the receiving part of the lower partition plate along the flange of the box base plate, whereby the electrical component box is put on the lower partition plate to be fixed thereto. The box base plate of the electrical component box is held in an area increased by the receiving part of the lower partition plate. In addition, because the positioning can be easily achieved only by putting the electrical component box on the lower partition plate along the flange of the box base plate, the fixing work such as screwing or welding after the positioning can be performed more easily. As a result, the stability when the electrical component box is placed on the lower partition plate is higher, leading to enhanced setting workability of the electrical component box.

DETAILED DESCRIPTION

An outdoor unit 1 of an air conditioner according to the present invention is installed outdoors, and is connected to at least one indoor unit installed in an air-conditioned room by refrigerant piping, to thereby constitute a refrigeration cycle.

Figure 1:
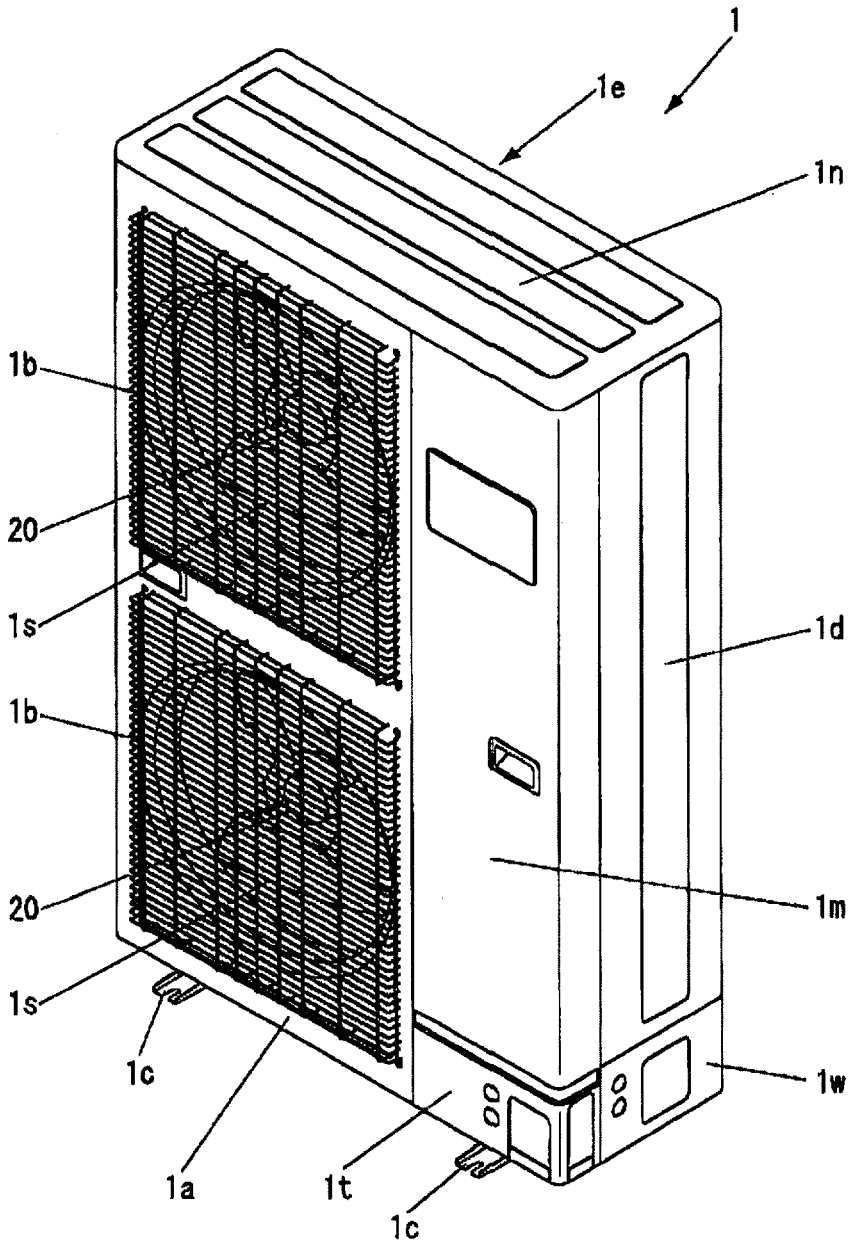
FIG. 1 is an external perspective view illustrating a front side of an outdoor unit according to the present invention.
Figure 2:
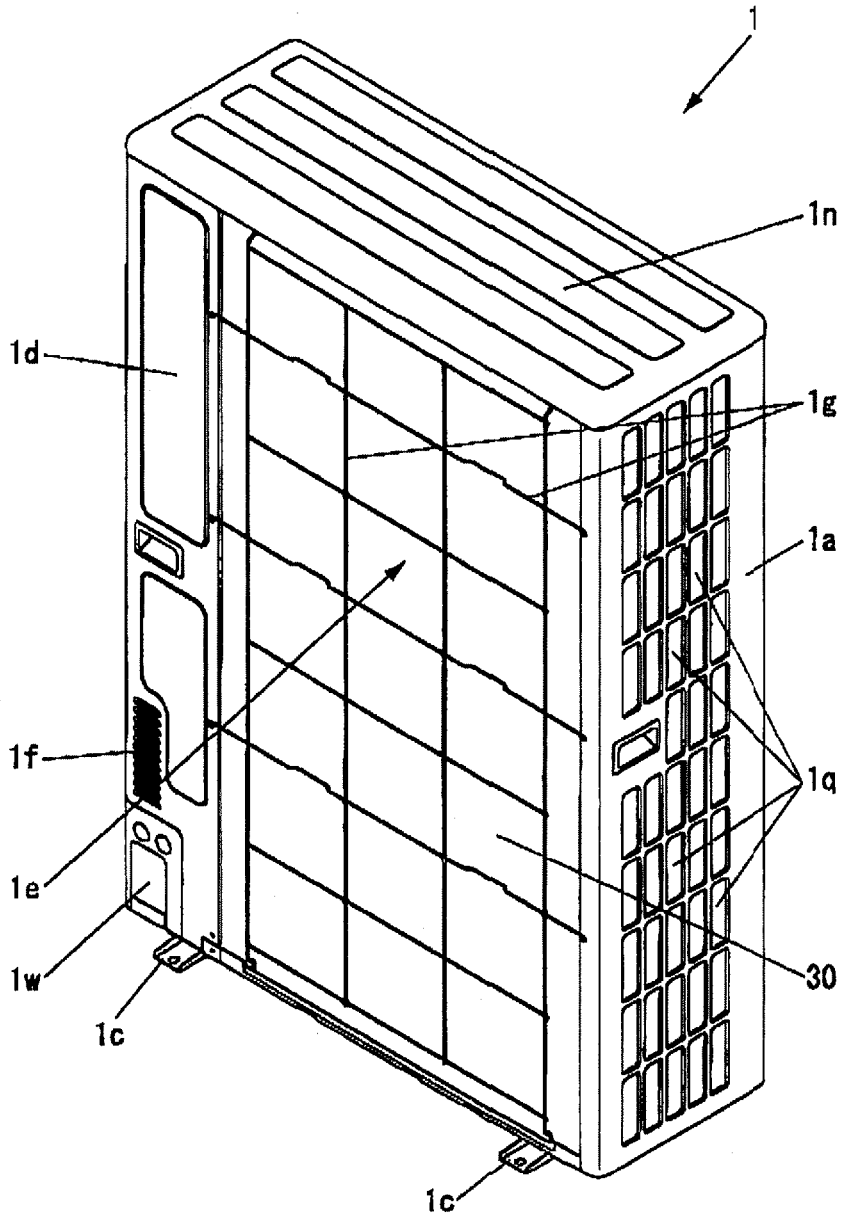
FIG. 2 is an external perspective view illustrating a back side of the outdoor unit according to the present invention.
Figure 3:
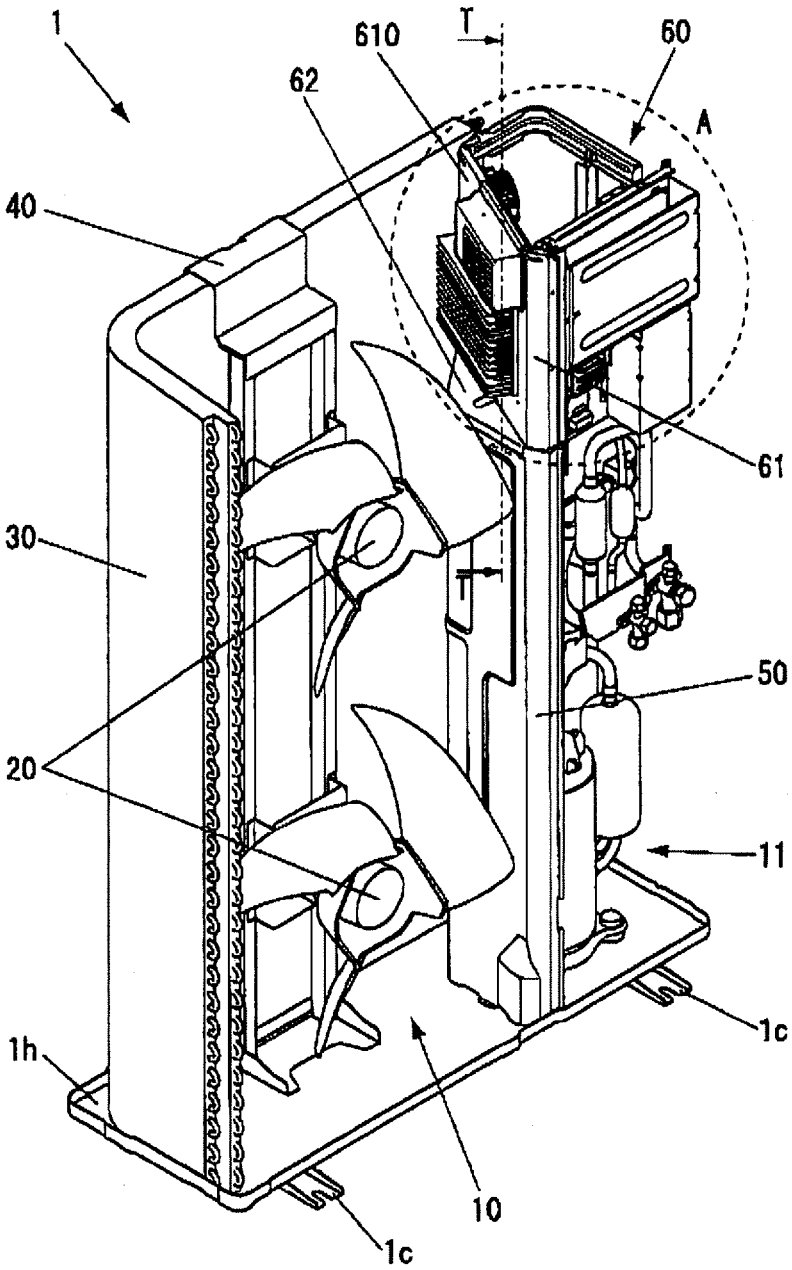
FIG. 3 is a schematic perspective view illustrating an internal structure of the outdoor unit according to the present invention.

Hereinafter, an embodiment of the present invention is described in detail with reference to the attached drawings. As illustrated in FIG. 1 to FIG. 3, the outdoor unit 1 of the air conditioner according to the present embodiment includes a substantially parallelepiped casing. The outer frame of the casing is formed by processing mainly a steel plate, and includes an L-shaped front panel 1*a* also serving as one side panel, an L-shaped back panel 1*d* also serving as another side panel, a service panel 1*m*, a bottom plate 1*h*, a top plate 1*n*, a front piping cover 1*t*, and a side piping cover 1*w*. The lower ends of the front panel 1*a*, part of the back panel 1*d*, the front piping cover 1*t*, and the side piping cover 1*w* are screwed to a flange in the periphery of the bottom plate 1*h*. The upper ends of the front panel 1*a* and the back panel 1*d* are screwed to the top plate 1*n* so as to be covered by the top plate 1*n*.

Note that description is given below assuming in the following manner. That is, in the casing of the outdoor unit 1 in FIG. 1, the side on which the front panel 1*a* is placed is the front, and the opposite side to the front is the back. Further, when the front panel 1*a* is viewed from the front, the side on which the service panel 1*m* is placed is the right, and the opposite side to the right is the left.

The inside of the casing of the outdoor unit 1 is divided by an upper partition plate 61 and a lower partition plate 50 as partition plates into a blower chamber 10 and a machinery chamber 11. The blower chamber 10 is mainly provided with two blower fans 20 and a heat exchanger 30. The heat exchanger 30 is formed into a substantially L-shape as viewed from the top, and is placed along from the left side to the back side of the casing of the outdoor unit 1. The two blower fans 20 are respectively attached to motors (not illustrated). The motors are attached to a motor support 40 fixed to the heat exchanger 30 with a predetermined vertical interval therebetween, whereby the two blower fans 20 are vertically aligned in the blower chamber 10.

A compressor, an accumulator, a four-way valve, and piping are housed in the machinery chamber 11. An electrical component box 60 is placed above the machinery chamber 11. The electrical component box 60 is fixed to the lower partition plate 50 with the intermediation of a box base plate 62 that receives the electrical component box 60. The lower partition plate 50 is made of a steel plate, and has: one side end fixed to the right end of the front panel 1*a*; and another side end fixed to a piping outlet (not illustrated) on the back side of the heat exchanger 30. The lower end of the lower partition plate 50 is in contact with the bottom plate 1*h*. As illustrated in FIG. 7B, the lower partition plate 50 is bent so as to protrude toward the blower chamber 10, and the front side thereof with respect to the bent portion is a first partition part 50*b*, whereas the back side thereof with respect to the bent portion is a second partition part 50*d*. A bent part 50*c* bent in multiple steps is provided at the leading end part of the first partition part 50*b*. A leading end surface of the bent part 50*c* is substantially parallel to the front surface of the outdoor unit 1. In addition, a flange 50*e* bent toward the back side is provided at the leading end part of the second partition part 50*d*. Furthermore, a receiving part 50*a* bent inward is provided at the upper end parts of the first partition part 50*b* and the second partition part 50*d*.

As illustrated in FIG. 1 to FIG. 3, the front panel 1*a* is formed by bending a steel plate into a substantially L-shape as viewed from the top, from the front side to the left side of the outdoor unit 1. The front panel 1*a* is placed so as to cover a portion corresponding to the blower chamber 10 on the front side of the casing of the outdoor unit 1 and the entire left side of the outdoor unit 1. On the front side of the front panel 1*a*, two blow-off windows 1*s* are opened into a circular shape at positions respectively corresponding to the blower fans 20, and the blow-off windows 1*s* discharge, to the outside, air that has been suctioned into the blower chamber 10 of the outdoor unit 1 by the blower fans 20. Fan guards 1*b* that respectively cover the blow-off windows 1*s* are attached to the front panel 1*a*. A suction port 1*q* formed of a plurality of rectangular holes is provided on the left side of the front panel 1*a*.

The back panel 1*d* is formed by bending a steel plate into a substantially L-shape as viewed from the top, from the back side to the right side of the outdoor unit 1. The back panel 1*d* is placed so as to cover the back side of the machinery chamber 11 of the outdoor unit 1 and cover the right side of the outdoor unit 1 together with the service panel 1*m* to be described later. An air intake hole 1*f* is opened in a back-side lower portion of the back panel 1*d*, and the air intake hole 1*f* serves to take external air into the machinery chamber 11 by means of the blower fans 20.

The service panel 1*m* is formed by bending a steel plate into a substantially L-shape as viewed from the top, from the front side to the right side of the outdoor unit 1. The service panel

1*m* is placed so as to cover a portion corresponding to the machinery chamber 11 of the outdoor unit 1 and cover the right side of the outdoor unit 1 together with the back panel 1*d*. The service panel 1*m* is detachably attached in order to facilitate access to the machinery chamber 11 at the time of maintenance work for the outdoor unit 1.

Note that the heat exchanger 30 is exposed between the side end of the back panel 1*d* and the side end of the front panel 1*a* on the back side of the casing of the outdoor unit 1, and the exposed portion serves as a back suction port 1*e* for taking external air into the blower chamber 10 by means of the blower fans 20. A protecting member 1*g* is provided for the back suction port 1*e*.

The bottom plate 1*h* is made of a steel plate having a substantially rectangular shape, and the flange bent upward at a substantially right angle is formed in the periphery of the bottom plate 1*h*. In addition, leg parts 1*c* extending in the front-back direction of the outdoor unit 1 are provided at right and left portions on the lower surface of the bottom plate 1*h*, and the leg parts 1*c* serve for installation of the outdoor unit 1 on the ground or the like.

The top plate 1*n* is made of a steel plate having a substantially rectangular shape, and a flange bent downward is formed in the periphery of the top plate 1*n*. The top plate 1*n* is screwed to the upper ends of the front panel 1*a*, the service panel 1*m*, and the back panel 1*d*. Note that a heat insulating material (not illustrated) is attached to a portion corresponding to the electrical component box 60 on the rear side of the top plate 1*n*.

Next, a configuration of the electrical component box 60 is described. As illustrated in FIG. 4 to FIG. 8, a basic structure of the electrical component box 60 is formed of a front plate 63, an arm 64, and a support post 65 in addition to the upper partition plate 61 and the box base plate 62.

The upper partition plate 61 is made of a steel plate, and is provided with an attachment part 610 that is formed on a straight line defined by connecting a joint part between the front panel 1*a* and the lower partition plate 50 to the vicinity of the piping outlet of the heat exchanger 30, in consideration of ventilation efficiency. A first front bent part 611 and a second front bent part 612 that are bent in two steps are formed at the front-side side end of the attachment part 610. Specifically, the first front bent part 611 is bent at an obtuse angle to the attachment part 610, and the second front bent part 612 is formed by further bending the leading end of the first front bent part 611 at an obtuse angle to the first front bent part 611 so as to be substantially parallel to the front surface of the outdoor unit 1. The leading end of the second front bent part 612 is bent at a substantially right angle toward the back side, whereby a front flange 616 is formed. A back bent part 613 bent at an obtuse angle to the attachment part 610 is formed at the back-side side end of the attachment part 610. The side end of the back bent part 613 is bent toward the back side, whereby a back flange 617 is formed. An upper flange 614 that is bent at a substantially right angle toward the inside of the electrical component box 60 is formed at the upper ends of the attachment part 610, the first front bent part 611, and the back bent part 613. A lower flange 615 that is bent at a substantially right angle toward the inside of the electrical component box 60 is formed at the lower ends of the attachment part 610, the first front bent part 611, and the back bent part 613.

Figure 4:
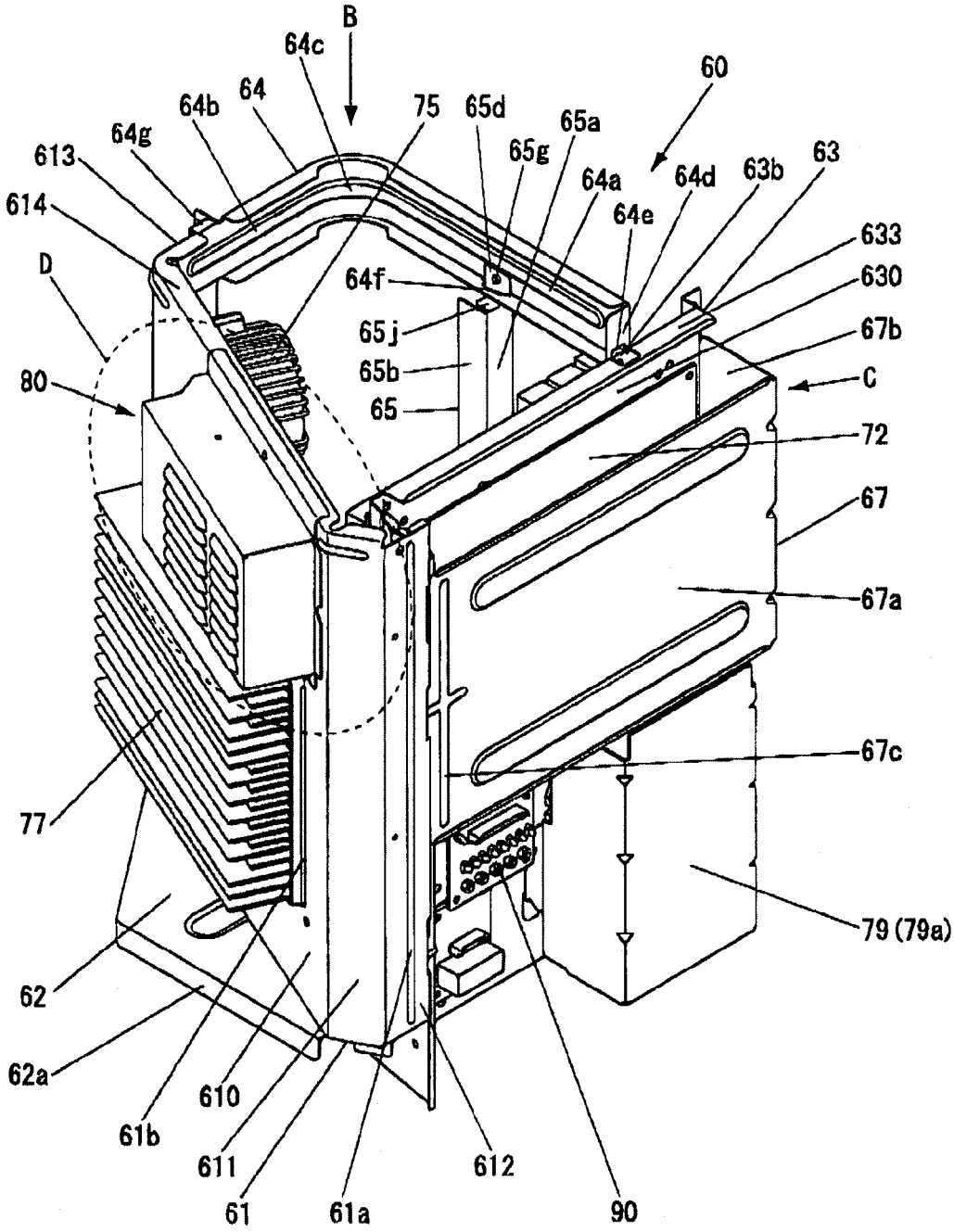
FIG. 4 is an enlarged view of a part A in FIG. 3 and is a perspective view of an electrical component box according to the present invention.
Figure 5:
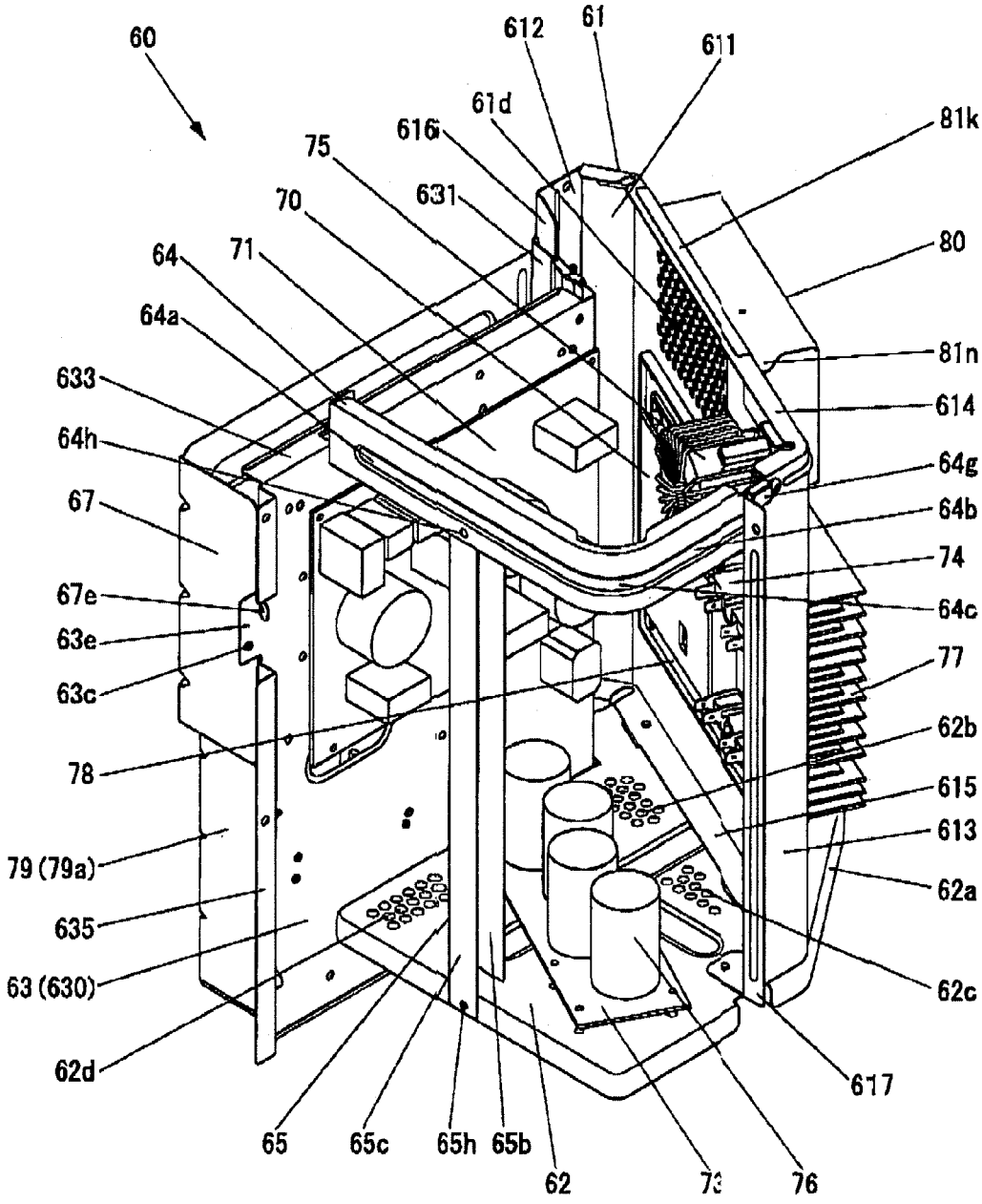
FIG. 5 is a perspective view of the electrical component box, which is taken in a direction indicated by an arrow B in FIG. 4.
Figure 6:
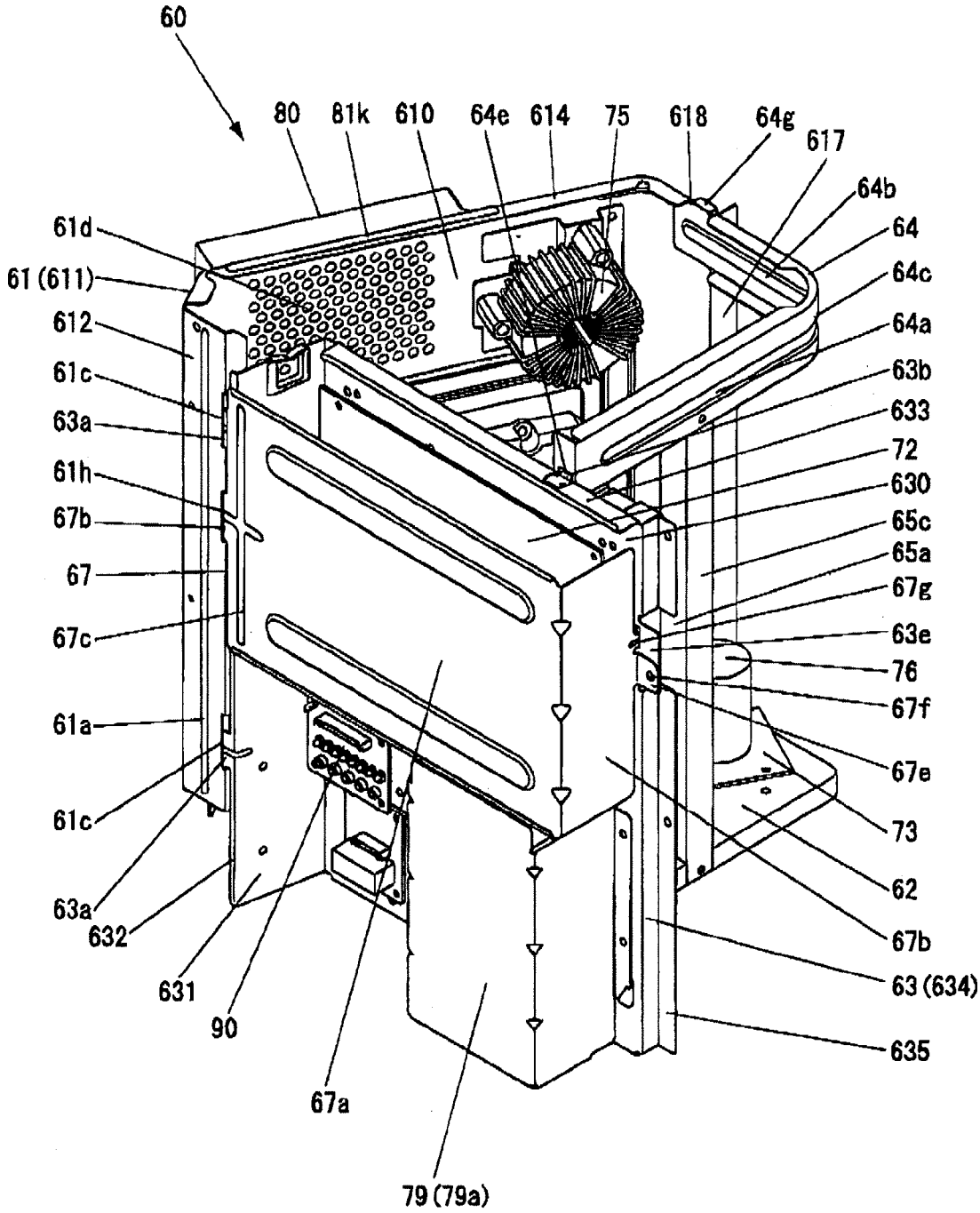
FIG. 6 is a perspective view of the electrical component box, which is taken in a direction indicated by an arrow C in FIG. 4.
Figure 7A:
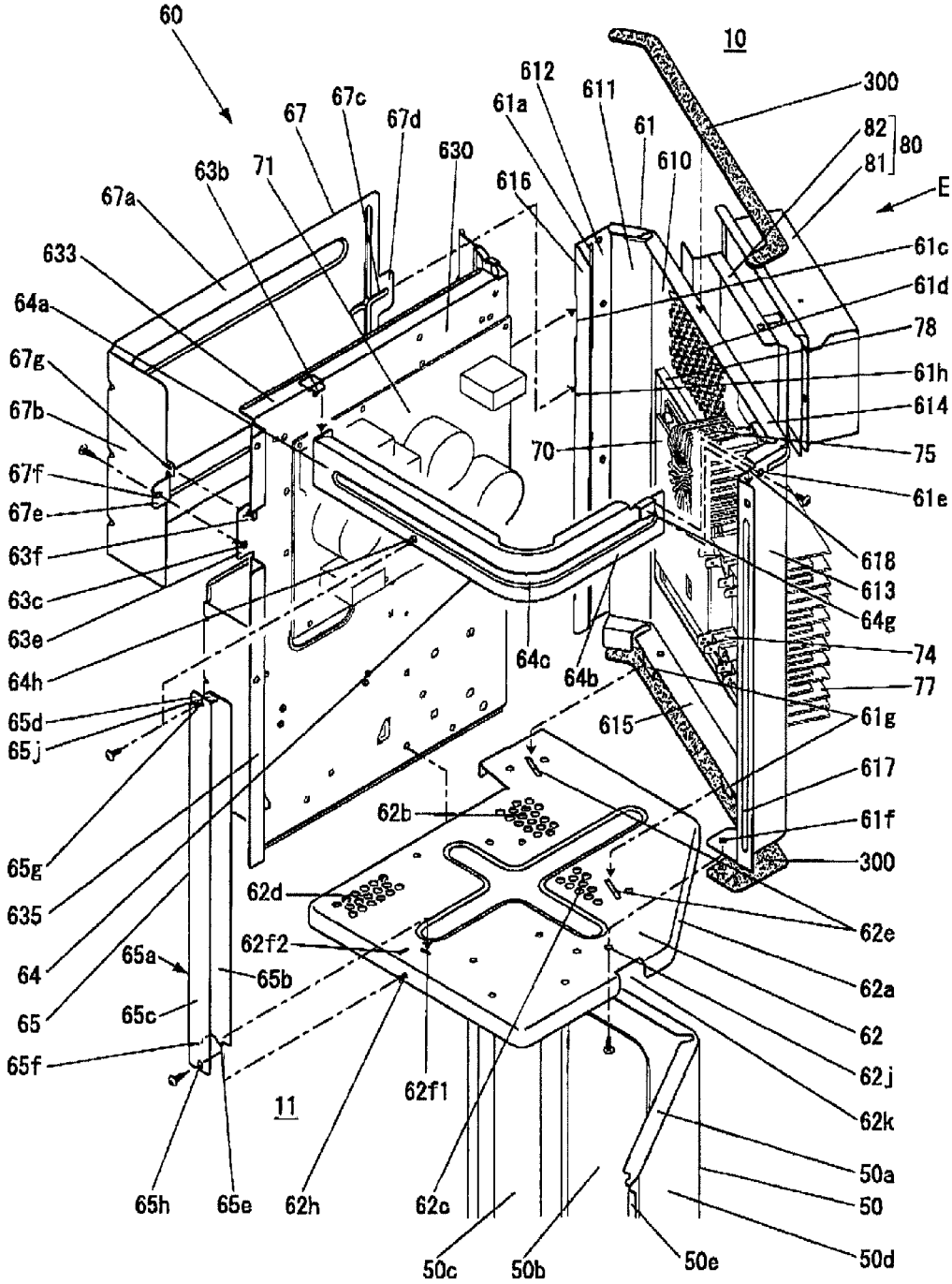
FIG. 7A is an exploded perspective view illustrating a main part of the electrical component box.
Figure 7B:
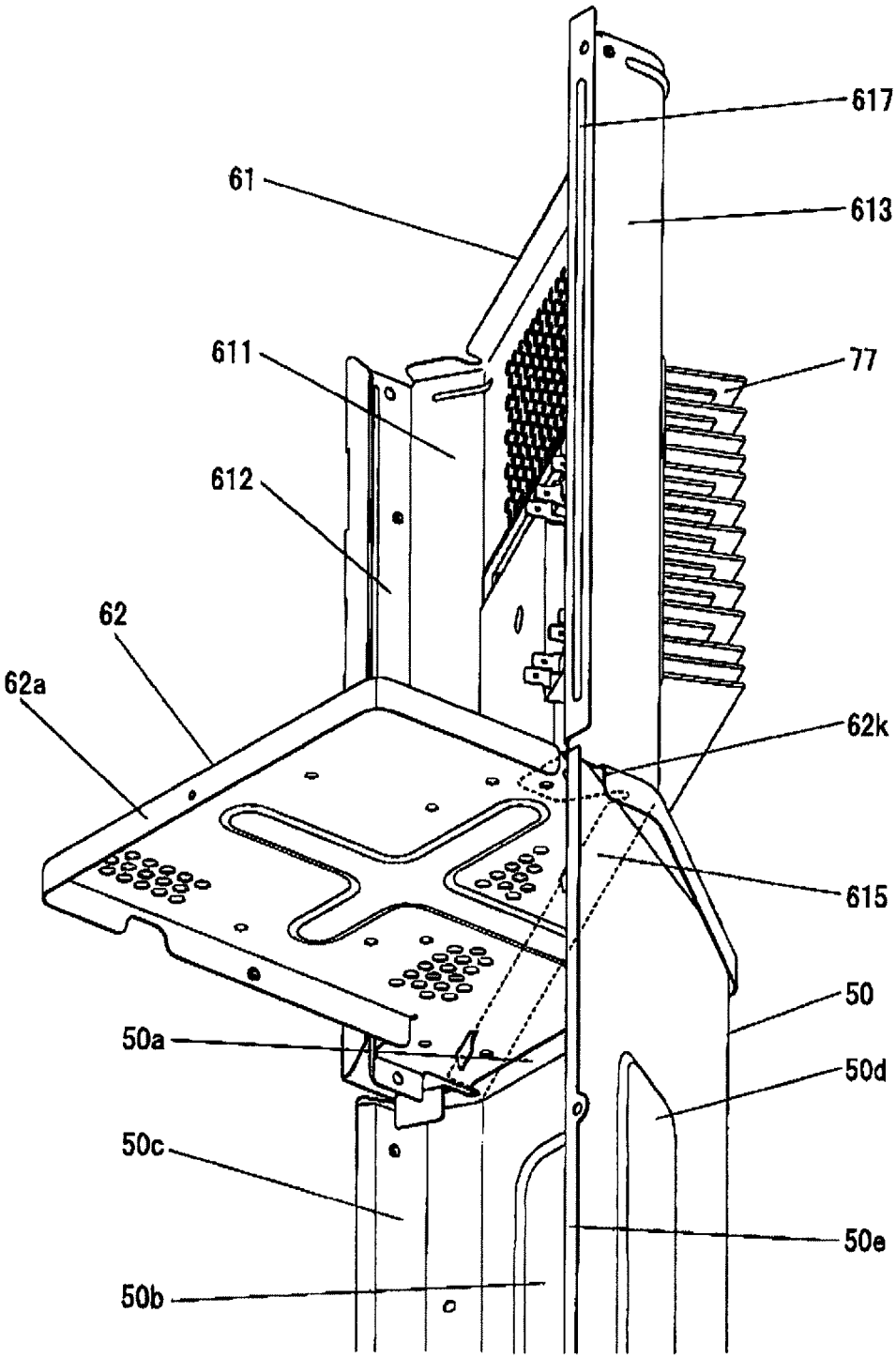
FIG. 7B is a perspective view illustrating the main part, which is taken from a lower partition plate side.

As illustrated in FIG. 4 and FIG. 7A, a ventilation hole 61*d* formed of a plurality of circular holes is opened in an upper portion of the attachment part 610. A water blocking member 80 including a water blocking cover 81 and an inner partition plate 82 is attached to the upper portion of the attachment part 610 on the blower chamber 10 side so as to cover the ventilation hole 61*d*. As illustrated in FIG. 4, a rectangular heat sink hole 61*b* is opened in the center of the attachment part 610. As illustrated in FIG. 4 and FIG. 5, a heat sink 77 is attached to the heat sink hole 61*b* with the intermediation of a heat sink mount 78 made of a resin material such that a fin part of the heat sink 77 protrudes in the blower chamber 10. As illustrated in FIG. 7A, an inverter board 70 and a power module 74 are attached to the back side of the heat sink 77. A reactor 75 is attached thereto above the power module 74. The inverter board 70, the power module 74, and the reactor 75 constitute part of a power supply circuit, and heat generated by a heater element (not illustrated) mounted on the inverter board 70 and by the power module 74 during the operation of the power supply is transferred to the heat sink 77 to be released.

Figure 8:
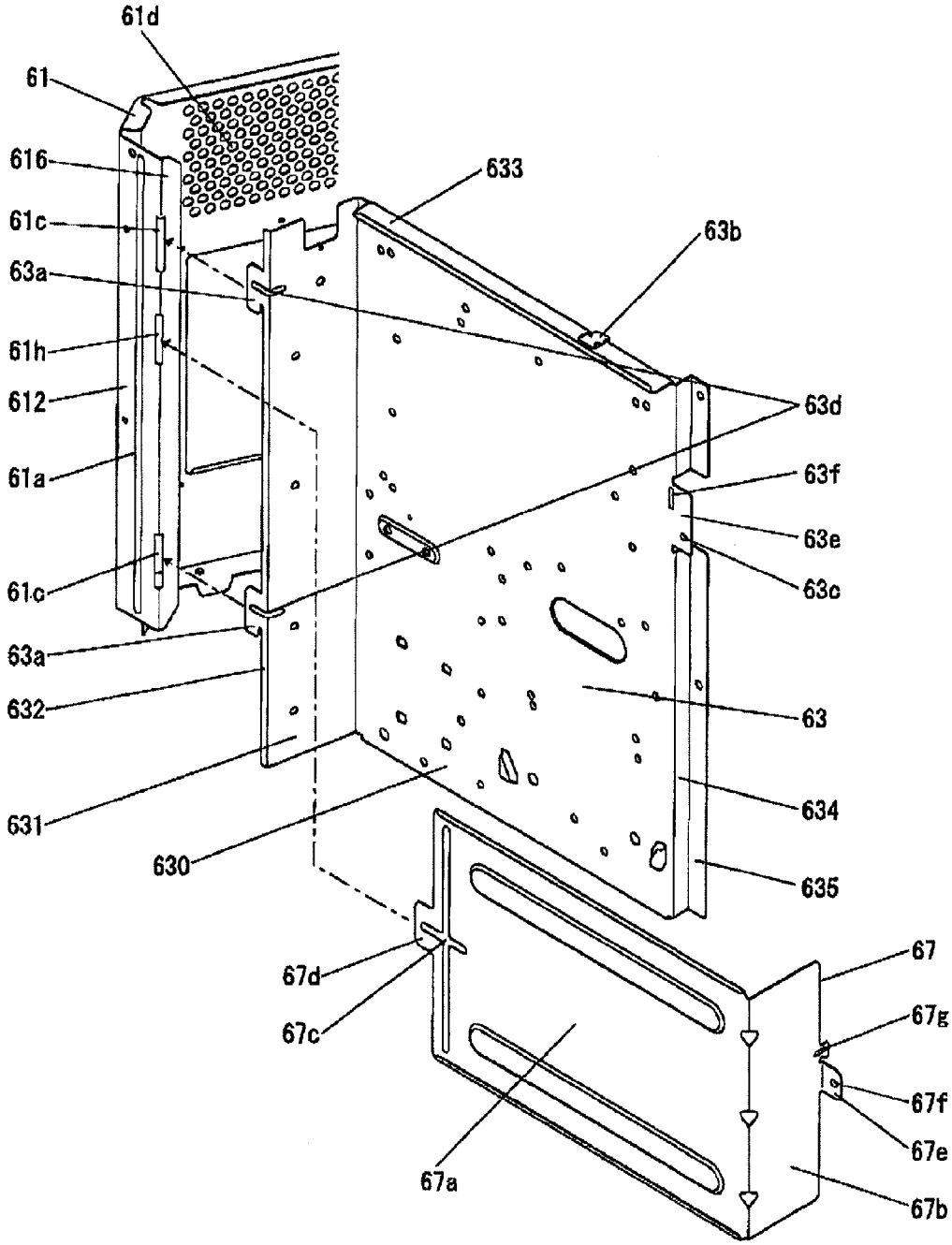
FIG. 8 is an explanatory view of an upper partition plate, a front plate, and a front plate cover.

The second front bent part 612 is provided with a bead 61*a* in the top-bottom direction in order to obtain mechanical strength. As illustrated in FIG. 8, hinge slits 61*c* having a predetermined shape are provided with a vertical interval therebetween in a joint part between the second front bent part 612 and the front flange 616. An insertion piece slit 61*h* is provided on the upper side (on the upper hinge slit 61*c* side) with respect to the middle between the upper and lower hinge slits 61*c*.

As illustrated in FIG. 7A, a hook engagement part 618 is provided at part of the upper end of the back bent part 613, and the hook engagement part 618 is formed by cutting out the upper flange 614 at a predetermined size from the back flange 617 toward the blower chamber 10. An upper screw hole 61*e* is provided in an upper portion of the back bent part 613.

Insertion pieces 61*g* are provided in front and back portions of the lower flange 615 provided at the lower end of the attachment part 610 so as to protrude downward. A bottom screw hole 61*f* is provided in the lower flange 615 provided below the back bent part 613.

As illustrated in FIG. 7A, the box base plate 62 is made of a polygonal steel plate, and has a blower chamber 10 side that is shaped so as to be engaged with the upper end part of the lower partition plate 50. A flange 62*a* bent downward is formed in the periphery of the box base plate 62. A first ventilation hole 62*b*, a second ventilation hole 62*c*, and a third ventilation hole 62*d* each formed of a plurality of circular holes are opened in the box base plate 62. The first ventilation hole 62*b* is provided near immediately below the inverter board 70 and at a position separated from the ventilation hole 61*d* of the upper partition plate 61. The second ventilation hole 62*c* is provided near immediately below the power module 74 and at a position separated from the ventilation hole 61*d* of the upper partition plate 61. The third ventilation hole 62*d* is provided immediately below a filter board 71 of the front plate 63 and at a position separated from the ventilation hole 61*d* of the upper partition plate 61. In addition, two first slits 62*e* are provided in the vicinity of the first ventilation hole 62*b* and the second ventilation hole 62*c* so as to correspond the shape and position of the insertion pieces 61*g* of the upper partition plate 61. A second slit 62*f*1 and a third slit 62*f*2 are provided in substantially the center of the front-back direction near the right end of the box base plate 62 so as to respectively correspond the shapes and positions of a second insertion piece 65*e* and a third insertion piece 65*f* of the support post 65 to be described later. A base screw hole 62*j* is provided in substantially the center of the left-right direction near the back end of the box base plate 62 so as to correspond to the position of the bottom screw hole 61*f* of the upper partition plate 61. A portion of the flange 62*a* corresponding to the base screw hole 62*j* is cut out to be formed into a cut-out part 62*k*. A side screw hole 62*h* is provided in substantially the center of the left-right direction of the flange 62*a* at the right end of the box base plate 62. As illustrated in FIG. 5, a capacitor board 73 on which a plurality of capacitors 76 are mounted is attached to substantially the center of the box base plate 62. The capacitor board 73 is placed so as not to block the first ventilation hole 62*b*, the second ventilation hole 62*c*, and the third ventilation hole 62*d*.

As illustrated in FIG. 8, the front plate 63 is made of a steel plate, and includes an attachment part 630 that forms the front side of the electrical component box 60. A side face part 631 that is bent at a substantially right angle toward the front side is formed at the left end of the attachment part 630. The leading end of the side face part 631 is bent at a substantially right angle toward the left side, whereby a left end flange 632 is formed. The right end of the attachment part 630 is bent at a substantially right angle toward the back side, whereby a bent part 634 is formed. The leading end of the bent part 634 is bent at a substantially right angle toward the right side, whereby a right end flange 635 is formed. In addition, an upper flange 633 that is bent at a substantially right angle toward the front side of the electrical component box 60 is formed at the upper end of the attachment part 630.

A fixing part 63*e* is provided in a right-end upper portion of the attachment part 630, and the fixing part 63*e* is formed by cutting part of the bent part 634 and processing the part so as to protrude toward the right side. The fixing part 63*e* is provided with a screw hole 63*c* and a slit 63*f* for fixing a front plate cover 67 to be described later. In addition, the filter board 71 that removes noise entering from a commercial power supply and the like is attached to an upper portion on the rear side of the attachment part 630 (on the inner side of the electrical component box 60). As illustrated in FIG. 4, a control board 72 that controls the operation of the outdoor unit 1 is attached to a front-side upper portion of the attachment part 630, and a terminal part 79 formed of a terminal mount (not illustrated) and a terminal mount cover 79*a* covering the terminal mount is attached to a front-side lower right portion of the attachment part 630. A display board 90 that displays the operation state of the outdoor unit 1 is further attached to a front-side lower left portion of the attachment part 630.

As illustrated in FIG. 8, the left end flange 632 is provided with two upper and lower hinge pieces 63*a*, and the hinge pieces 63*a* are placed at positions respectively corresponding to the hinge slits 61*c* of the upper partition plate 61 so as to protrude toward the left side. Each hinge piece 63*a* is provided with a bead 63*d* in order to increase mechanical strength of the hinge piece 63*a*, and the bead 63*d* extends from the side face part 631 to the hinge piece 63*a* so as to protrude toward the front side.

An insertion piece 63*b* is provided in a right portion of the upper flange 633, and the insertion piece 63*b* is formed by cutting part of the upper flange 633 so as to protrude toward the back side.

As illustrated in FIG. 8, the front plate cover 67 is made of a steel plate, and a front part 67*a* is formed therein so as to cover the control board 72 attached to the attachment part 630 of the front plate 63. A side part 67*b* that is bent at a substantially right angle toward the back side is formed at the right end of the front part 67*a*.

A first insertion piece 67*d* corresponding to the insertion piece slit 61*h* of the upper partition plate 61 is provided in substantially the center of the top-bottom direction at the left end of the front part 67*a*. A substantially cross-shaped bead 67*c* for obtaining mechanical strength is provided at the root of the first insertion piece 67*d* so as to protrude toward the front side. Part of the horizontal portion of the bead 67*c* runs on the first insertion piece 67*d*.

In addition, a second insertion piece 67*g* engaged with the slit 63*f* of the front plate 63 is provided at the leading end of the side part 67*b* so as to protrude toward the back side. A fixing piece 67*e* including a screw hole 67*f* is formed by bending below the second insertion piece 67*g* so as to follow the fixing part 63*e* of the front plate 63.

As illustrated in FIG. 5, the arm 64 is formed by bending an elongated steel plate into a substantially L-shape with a significantly rounded corner as viewed from the top. A right arm part 64*a* is placed in a portion corresponding to the right side of the electrical component box 60 with respect to a circular arc-shaped bent part 64*c*. A back arm part 64*b* is placed in a portion corresponding to the back side of the electrical component box 60 with respect thereto. Flanges that are bent at a substantially right angle toward the inside of the electrical component box 60 are respectively provided at the upper and lower ends of the right arm part 64*a* and the back arm part 64*b*, whereby mechanical strength is ensured. Beads are respectively provided on outer surfaces of the right arm part 64*a*, the back arm part 64*b*, and the bent part 64*c*, whereby mechanical strength is similarly ensured.

As illustrated in FIG. 4, an abutment surface 64*d* that is bent at a substantially right angle toward the inside of the electrical component box 60 is formed at the leading end of the right arm part 64*a*. A first insertion hole 64*e* engaged with the insertion piece 63*b* of the front plate 63 is provided in the abutment surface 64*d* of the right arm part 64*a*. A second insertion hole 64*f* engaged with a first insertion piece 65*d* of the support post 65 to be described later is provided in substantially the center of the front-back direction at the lower end of the right arm part 64*a*. A screw hole 64*h* is provided above the second insertion hole 64*f* in the outer surface of the right arm part 64*a*.

As illustrated in FIG. 5, a hook 64*g* bent into a substantially L-shape is provided in an upper portion on the left side (blower chamber 10 side) of the back arm part 64*b*.

As illustrated in FIG. 4 and FIG. 5, the support post 65 is made of a steel plate formed into a U-shape in cross-section, and includes: a front part 65*a* on the front side of the electrical component box 60; a left part 65*b* on the inner side of the electrical component box 60; and a right part 65*c* on the outer side of the electrical component box 60. The left part 65*b* and the right part 65*c* are formed by bending the respective end parts of the front part 65*a* at a substantially right angle toward the back side of the electrical component box 60.

As illustrated in FIG. 7A, the upper end of the front part 65*a* is bent toward the back side of the electrical component box 60, whereby a receiving part 65*j* that receives the right arm part 64*a* of the arm 64 is formed. The third insertion piece 65*f* engaged with the third slit 62*f*2 of the box base plate 62 is formed at the lower end of the front part 65*a*.

The second insertion piece 65*e* engaged with the second slit 62*f*1 of the box base plate 62 is formed at the lower end of the left part 65*b*. The upper end of the right part 65*c* is longer than those of the front part 65*a* and the left part 65*b*. The upper end of the right part 65*c* is formed as the first insertion piece 65*d* engaged with the second insertion hole 64*f* of the arm 64 illustrated in FIG. 4, and an upper screw hole 65*g* is provided in the first insertion piece 65*d*. Further, a lower screw hole 65*h* is provided in a lower portion of the right part 65*c*.

Next, with reference to FIG. 4 to FIG. 9, description is given of how to assemble the electrical component box 60 having the configuration described above and how to join the electrical component box 60 to above the machinery chamber 11. First, as illustrated in FIG. 7A, the inner partition plate 82 and the water blocking cover 81 are attached in the stated order from the outer side (blower chamber 10 side) of the upper partition plate 61 so as to cover the ventilation hole 61*d*. Next, the heat sink mount 78 to which the heat sink 77 is attached is attached to the heat sink hole 61*b* provided in the attachment part 610 of the upper partition plate 61 illustrated in FIG. 4 such that the fin part of the heat sink 77 protrudes toward the blower chamber 10. The reactor 75 is attached to the inner side of the attachment part 610 (the inner side of the electrical component box 60), and the inverter board 70 and the power module 74 are attached to the rear side of the heat sink 77.

Next, a seal material 300 is attached to each of the upper flange 614 and the lower flange 615 of the upper partition plate 61. Then, the insertion pieces 61*g* of the upper partition plate 61 are respectively inserted into the first slits 62*e* of the box base plate 62 to be positioned. After that, the bottom screw hole 61*f* of the upper partition plate 61 is fixed with a screw to the base screw hole 62*j* of the box base plate 62.

Next, the support post 65 is joined to the arm 64. The first insertion piece 65*d* of the support post 65 is inserted into the second insertion hole 64*f* of the arm 64 illustrated in FIG. 4, whereby the lower end flange of the right arm part 64*a* is brought into contact with the receiving part 65*j* of the support post 65. After that, the upper screw hole 65*g* of the support post 65 is fixed with a screw to the screw hole 64*h* of the arm 64.

Next, the structure obtained by joining the support post 65 to the arm 64 is joined to the upper partition plate 61 and the box base plate 62 illustrated in FIG. 5 on which the capacitor board 73 having the capacitors 76 thereon is mounted. First, the hook 64*g* of the arm 64 is engaged with the hook engagement part 618 provided in the back bent part 613 of the upper partition plate 61. Then, the upper screw hole 61*e* of the upper partition plate 61 is fixed with a screw to a screw hole (not illustrated) of the back arm part 64*b*. The second insertion piece 65*e* of the support post 65 is inserted into the second slit 62*f*1 of the box base plate 62, and the third insertion piece 65*f* thereof is inserted into the third slit 62*f*2 of the box base plate 62. Then, the lower screw hole 65*h* of the support post 65 is fixed with a screw to the side screw hole 62*h* of the box base plate 62.

Next, the control board 72, the terminal part 79, and the display board 90 illustrated in FIG. 4 are attached to the front side of the attachment part 630 of the front plate 63. As illustrated in FIG. 7A, the filter board 71 is attached to the rear side of the attachment part 630 (the inner side of the electrical component box 60). Then, the front plate 63 is joined to the structure obtained by combining the upper partition plate 61, the box base plate 62, the arm 64, and the support post 65. First, the hinge pieces 63*a* of the front plate 63 illustrated in FIG. 8 are respectively inserted into the hinge slits 61*c* of the upper partition plate 61. Next, the insertion piece 63*b* of the front plate 63 is inserted into the first insertion hole 64*e* of the arm 64 illustrated in FIG. 4, and a lower portion of the front plate 63 is screwed to the front side of the box base plate 62.

Lastly, the front plate cover 67 is joined to the front plate 63. As illustrated in FIG. 7A, the first insertion piece 67*d* of the front plate cover 67 is inserted into the insertion piece slit 61*h* of the upper partition plate 61. Next, the second insertion piece 67*g* of the front plate cover 67 is inserted into the slit 63*f* provided in the fixing part 63*e* of the front plate 63. After that, the fixing piece 67*e* of the front plate cover 67 is brought into contact with the fixing part 63*e* of the front plate 63, and the screw hole 67*f* of the front plate cover 67 is fixed with a screw to the screw hole 63*c* of the front plate 63.

As has been described above, the electrical component box 60 has the structure in which the upper partition plate 61, the front plate 63, and the box base plate 62 are joined to one another and are supported by the arm 64 and the support post 65. The upper partition plate 61 is provided with the front flange 616 and the back flange 617, to thereby obtain enhanced mechanical strength. In addition, the box base plate 62 is provided with the flange 62*a*, to thereby obtain enhanced mechanical strength, and a surface of the flange 62*a* receives the lower portion of the attachment part 630 of the front plate 63, whereby joining strength is enhanced. Further, the arm 64 substantially perpendicularly supports the front plate 63 in the front-back direction, and the arm 64 also supports the back bent part 613 of the upper partition plate 61 in the state where the back arm part 64*b* of the arm 64 is flush with the back bent part 613. Hence, even if the electrical component box 60 receives an impact in the front-back direction and the left-right direction, strength high enough to withstand the impact can be obtained. Furthermore, the upper end parts of the front part 65*a* and the left part 65*b* of the support post 65 abut against the flange provided at the lower end of the right arm part 64*a* of the arm 64, and the lower end parts of the front part 65*a* and the left part 65*b* of the support post 65 abut against the box base plate 62. As a result, the support post 65 is perpendicularly joined to the right arm part 64*a* of the arm 64 and the box base plate 62, to thereby support the right arm part 64*a* of the arm 64 and the box base plate 62 in the top-bottom direction. Hence, even if the electrical component box 60 receives an impact in the top-bottom direction, strength high enough to withstand the impact can be obtained. Accordingly, the amount of used material (steel plate) on the back side and right side of the electrical component box 60 can be reduced. Furthermore, the electrical component box 60 having high strength against an impact applied in three directions (front-back/right-left/top-bottom directions) can be achieved. In addition, because the support post 65 supports the lower end of the right arm part 64*a* of the arm 64 in the top-bottom direction, the arm 64 does not deform downward under its own weight. Accordingly, at the time of attaching the front plate 63, the insertion piece 63*b* of the front plate 63 can be easily engaged with the first insertion hole 64*e* of the arm 64.

In addition, among the components and apparatuses constituting the power supply circuit, the reactor 75 and the power module 74 having a large amount of heat generation are placed on the upper partition plate 61, and the capacitors 76 similarly having a large amount of heat generation are installed on the box base plate 62 separately from the reactor 75 and the power module 74. Hence, the electrical component box 60 can be downsized compared with the case where these components are installed on one member (in the present embodiment, the upper partition plate 61) constituting the casing of the electrical component box 60.

Figure 9:
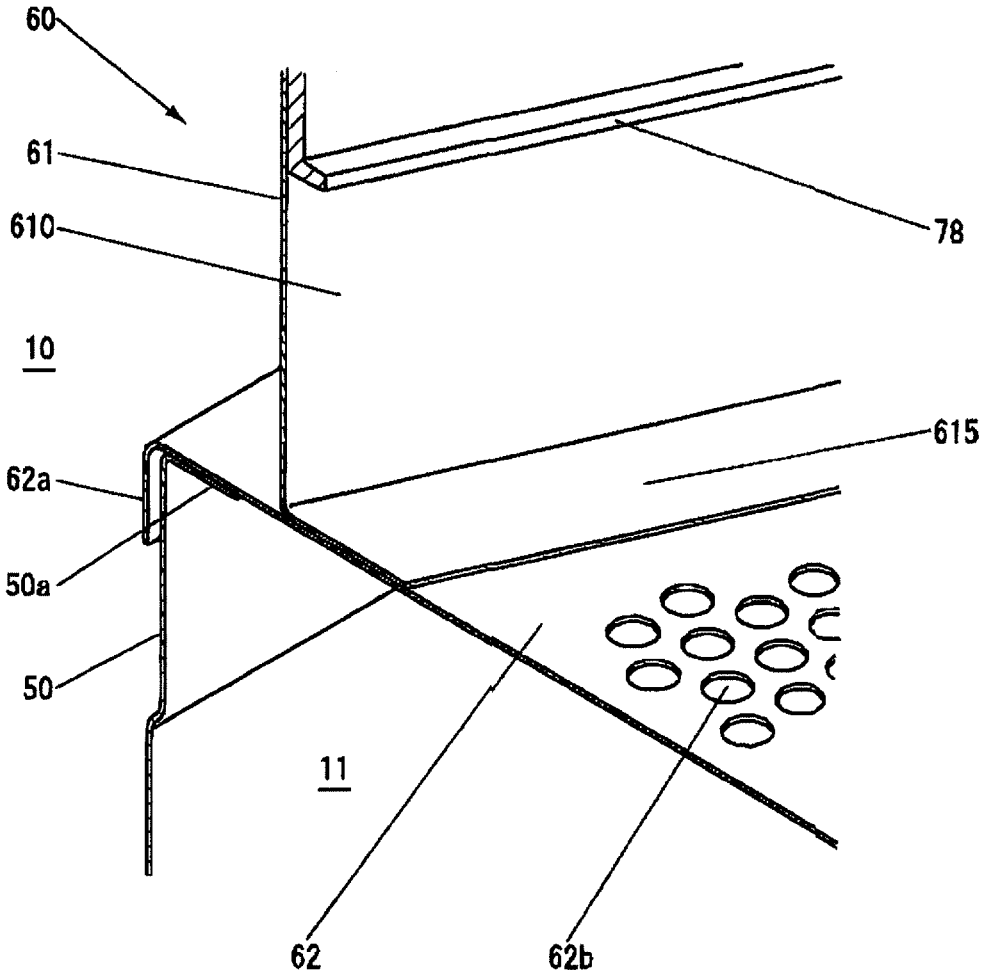
FIG. 9 is a cross-sectional view taken along a line T-T in FIG. 3.

Next, with reference to FIG. 7B and FIG. 9, description is given of how to join the electrical component box 60 to above the machinery chamber 11. As illustrated in FIG. 9, the blower chamber 10 side of the box base plate 62 is shaped so as to be engaged with the upper end part of the lower partition plate 50. The lower partition plate 50 is provided with the receiving part 50*a* that is formed by bending inward the upper end part of the lower partition plate 50. At the time of joining the electrical component box 60 to the lower partition plate 50, the box base plate 62 is set onto the receiving part 50*a* of the lower partition plate 50 along the flange 62*a* of the box base plate 62, whereby the electrical component box 60 can be positioned. After that, the electrical component box 60 is fixed to the lower partition plate 50 by fastening with a screw, welding, or any other suitable method.

Note that, as illustrated in FIG. 7B, at the time of setting the box base plate 62 onto the lower partition plate 50, the vicinity of the upper leading end of the second partition plate 50*d* is engaged with the cut-out part 62*k* of the box base plate 62, and the flange 50*e* protrudes toward the back side from the periphery of the box base plate 62.

In general, the electrical component box is heavy (approximately 10 kg). In addition, at the time of joining the electrical component box to above the machinery chamber, it is necessary to position the electrical component box with respect to the lower partition plate and screw or weld the electrical component box thereto while the electrical component box is held up. For example, in the case where (the upper partition plate of) the electrical component box is put for positioning on a small flange part of the upper surface of the lower partition plate and is screwed or welded thereto, it is necessary to perform the positioning and the screwing or welding while the heavy electrical component box is held up, resulting in decrease in workability.

In the present embodiment, such positioning can be achieved only by setting the electrical component box 60 (box base plate 62) onto the receiving part 50*a* of the lower partition plate 50 along the flange 62*a* of the box base plate 62. Accordingly, the positioning work is facilitated, and the fixing work such as screwing or welding after the positioning can be performed more easily, leading to simpler work and enhanced workability. In addition, the electrical component box 60 is joined to above the machinery chamber 11 in the state where the box base plate 62 is fixed to the lower partition plate 50. Hence, the upper partition plate 61 does not need to be shaped so as to accord with the shape of the lower partition plate 50 (for example, so as to have the same shape as that of the lower partition plate 50). Accordingly, the degree of freedom in the shape of the upper partition plate 61 is higher, and, for example, in the case as in the present embodiment where the heavy electrical components such as the power module 74 and the reactor 75 are attached to the upper partition plate 61, the shape of the upper partition plate 61 can be determined in the following manner. As illustrated in FIG. 7B, the upper end part of the bent part 50*c* of the lower partition plate 50 supports the lower end parts of the first front bent part 611 and the second front bent part 612 of the upper partition plate 61 with the intermediation of the box base plate 62, and the upper end part of the second partition part 50*d* of the lower partition plate 50 supports the lower end part of the back bent part 613 of the upper partition plate 61 with the intermediation of the box base plate 62. With this structure, because the upper partition plate 61 is supported by both the box base plate 62 and the lower partition plate 50, the heavy upper partition plate 61 can be supported more firmly. Furthermore, the attachment part 610 of the upper partition plate 61 can be formed on the straight line defined by connecting the joint part between the front panel 1*a* and the lower partition plate 50 to the vicinity of the piping outlet on the back side of the heat exchanger 30, in order to enable the heat sink 77 to efficiently release heat in consideration of ventilation efficiency.

Note that, in the state where the electrical component box 60 is joined to above the machinery chamber 11 and where the top plate 1*n* of the outdoor unit 1 is then attached thereon, the upper flange 614 of the upper partition plate 61 abuts against the top plate 1*n* with the intermediation of the seal material 300. In addition, the flanges provided at the upper end parts of the right arm part 64*a* and the back arm part 64*b* of the arm 64 abut against the top plate 1*n* with the intermediation of the heat insulating material (not illustrated). With this structure, the upper partition plate 61 and the arm 64 also serve to reinforce the top plate 1*n*. In addition, the vicinity of the piping outlet of the heat exchanger 30 is coupled to the back flange 617 of the upper partition plate 61 and the flange 50*e* of the lower partition plate 50. Accordingly, the upper partition plate 61, that is, the electrical component box 60 is integrally fixed to the lower partition plate 50 by the heat exchanger 30, so that the electrical component box 60 can be fixed more firmly to above the machinery chamber 11.

Next, other effects of the electrical component box 60 of the outdoor unit 1 according to the present embodiment are described. First, with reference to FIG. 1 to FIG. 3 and FIG. 10, flows of air in the electrical component box 60 and effects thereof are described. As described above, the electrical component box 60 according to the present embodiment is provided with the box base plate 62 including the flange 62*a* in the periphery thereof, in order to obtain strength of the electrical component box 60. As illustrated in FIG. 3, the box base plate 62 is placed between the upper partition plate 61 and the lower partition plate 50, and hence the box base plate 62 may unfavorably hinder air from flowing into the electrical component box 60, the air having flown into the machinery chamber 11 from the air intake hole 1*f* provided in the back panel 1*d* illustrated in FIG. 2 by means of the blower fans 20. In order to solve this problem, the plurality of ventilation holes are opened in the box base plate 62, and air is taken from the machinery chamber 11 into the electrical component box 60 through the ventilation holes.

When the outdoor unit 1 starts operating and the blower fans 20 turn, a difference in air pressure occurs between the inside of the blower chamber 10 of the outdoor unit 1 and the other places (the outside of the outdoor unit 1, the inside of the machinery chamber 11, and the inside of the electrical component box 60). This difference in air pressure causes air to be suctioned into the blower chamber 10 from the back suction port 1*e* of the outdoor unit 1 and the suction port 1*q* provided on the left side of the outdoor unit 1. Further, air is suctioned also into the machinery chamber 11 from the air intake hole 1*f* provided in the lower portion of the back panel 1*d*. Because the difference in air pressure exists between the inside of the blower chamber 10 and the insides of the machinery chamber 11 and the electrical component box 60, the air that has been suctioned into the machinery chamber 11 from the air intake hole 1*f* passes through the inside of the electrical component box 60, and is discharged into the blower chamber 10 through the ventilation hole 61*d* of the upper partition plate 61.

Figure 10:
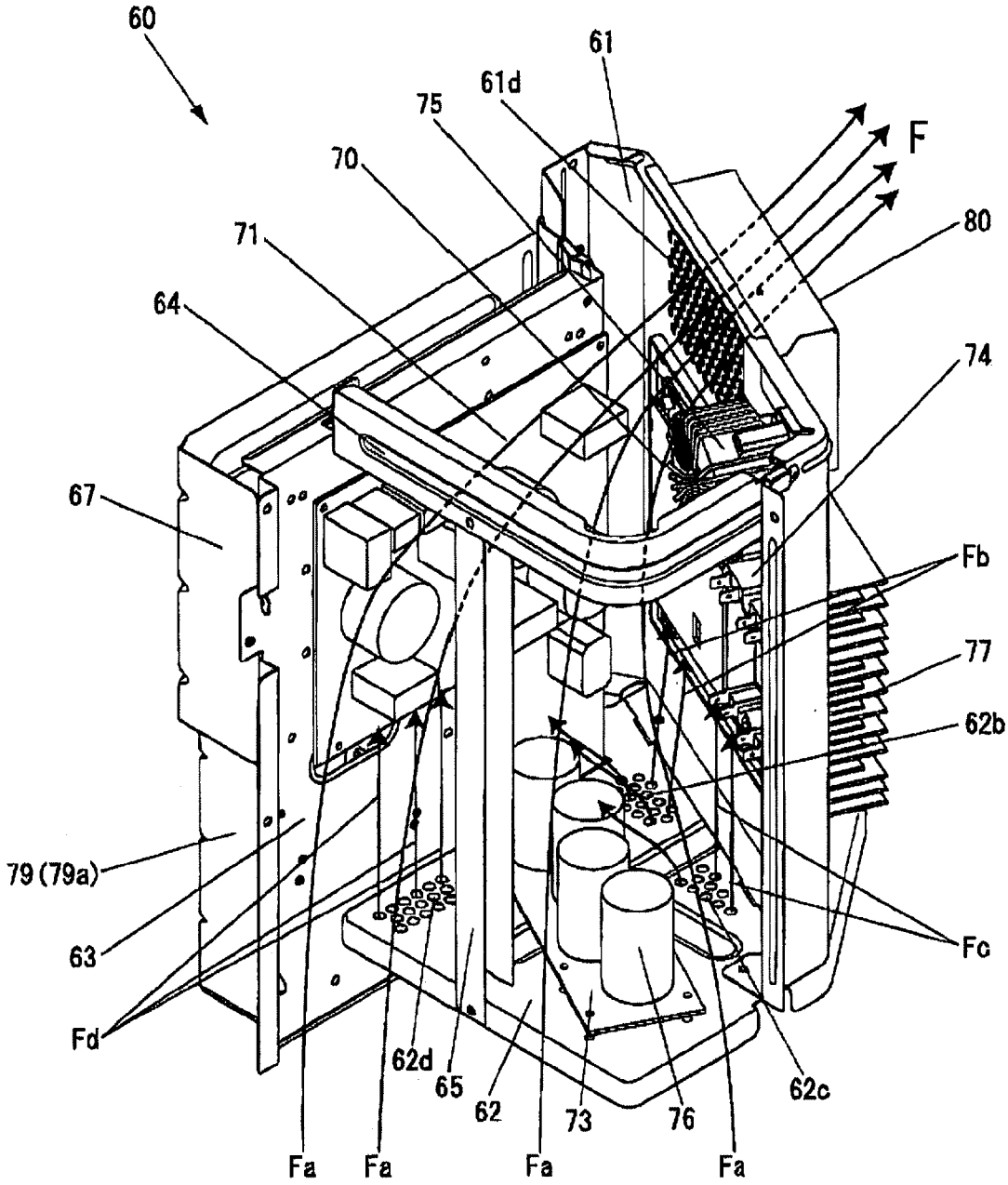
FIG. 10 is a view for describing flows of air in the electrical component box.

Specifically, as illustrated in FIG. 10, the flow of air from the machinery chamber 11 into the electrical component box 60 is divided into a flow of air Fa and flows of air Fb, Fc, and Fd. The flow of air Fa flows into the electrical component box 60 through open space defined by the upper partition plate 61, the box base plate 62, the front plate 63, and the arm 64, and the flows of air Fb, Fc, and Fd are separated from the flow of air Fa by the flange 62*a* of the box base plate 62. The flow of air Fb flows into the electrical component box 60 through the first ventilation hole 62*b*. The flow of air Fc flows into the electrical component box 60 through the second ventilation hole 62*c*. The flow of air Fd flows into the electrical component box 60 through the third ventilation hole 62*d*. The flow of air Fb and the flow of air Fc pass in the vicinity of the inverter board 70, the power module 74, and the reactor 75 attached to the upper partition plate 61 while flowing toward the ventilation hole 61*d* of the upper partition plate 61, and hence these components are cooled by the flow of air Fb and the flow of air Fc. Part of the flow of air Fb and part of the flow of air Fc flow in the vicinity of the capacitors 76, and hence the capacitors 76 are also cooled by the flow of air Fb and the flow of air Fc. The flow of air Fd passes in the vicinity of the filter board 71 while flowing toward the ventilation hole 61*d* of the upper partition plate 61, and hence the filter board 71 is cooled by the flow of air Fd. The flows of air Fb, Fc, and Fd join the flow of air Fa that wholly cools the inside of the electrical component box 60 to become a flow of discharged air F, and the flow of discharged air F is discharged into the blower chamber 10 through the ventilation hole 61*d* of the upper partition plate 61 and the water blocking member 80.

As has been described above, in the electrical component box 60, generated are the two types of flows of air: the flows of air Fb, Fc, and Fd that directly touch the board on which the heater element is mounted and the components and apparatuses having a large amount of heat generation; and the flow of air Fa that wholly cools the inside of the electrical component box 60. In the case where the electrical component box 60 is not provided with the box base plate 62, the air flowing from the machinery chamber 11 into the electrical component box 60 flows evenly through the electrical component box 60, and hence the air evenly cools the boards and the electrical components housed in the electrical component box 60 regardless of the amount of heat generation. In contrast to this, in the electrical component box 60 according to the present embodiment, the flange 62*a* is provided in the periphery of the box base plate 62 such that the air selectively touches the board on which the element having a large amount of heat generation is mounted and the electrical components having a large amount of heat generation. Further, the ventilation holes are opened at a plurality of positions of the box base plate 62 so as to correspond to these board and electrical components. Accordingly, the board on which the heater element is mounted and the components and apparatuses having a large amount of heat generation, which are housed in the electrical component box 60, can be effectively cooled, and hence the heat release effect can be enhanced.

Figure 11:
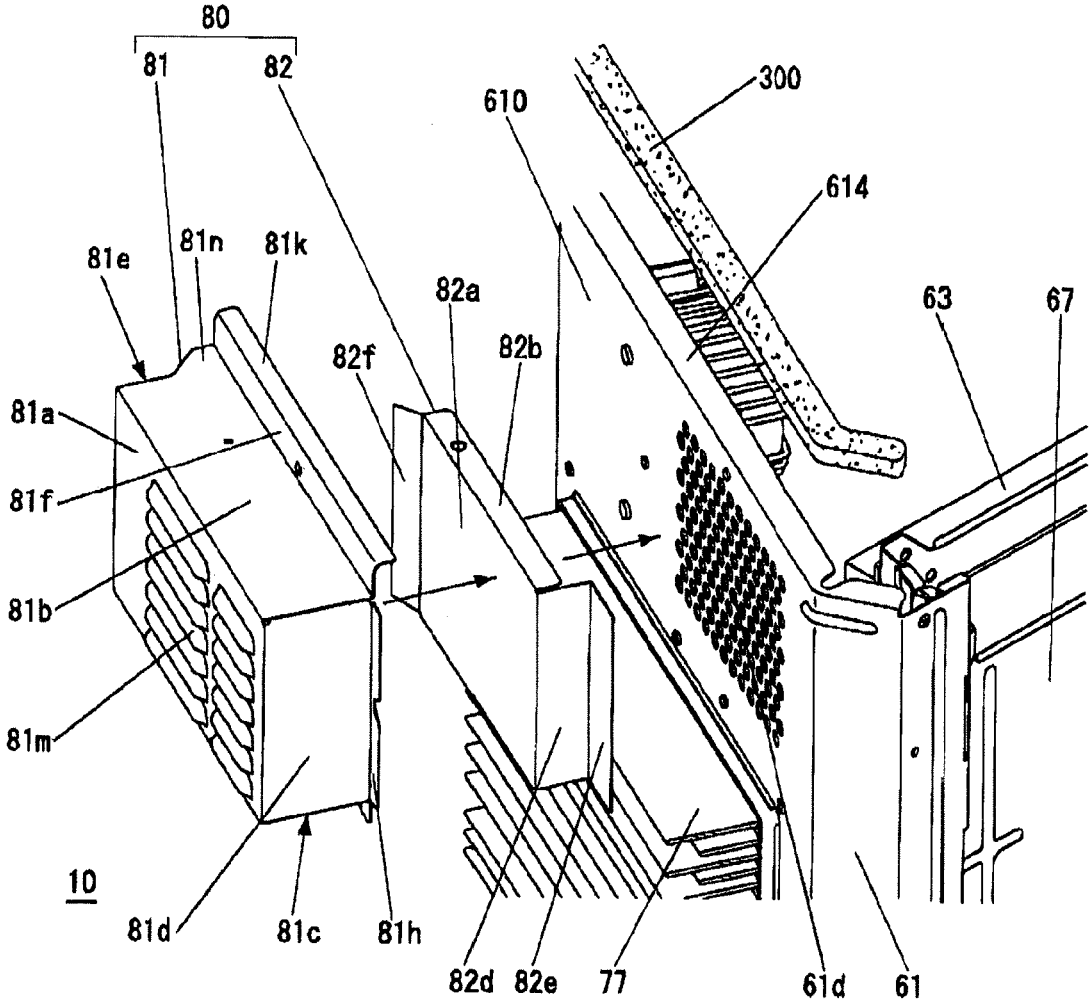
FIG. 11 is an exploded view of a water blocking member, which is taken in a direction indicated by an arrow E in FIG. 7A.

Next, with reference to FIG. 11 to FIG. 14, the water blocking member 80 that covers the ventilation hole 61*d* of the upper partition plate 61 is described. As illustrated in FIG. 11, the water blocking member 80 includes the water blocking cover 81 and the inner partition plate 82. The water blocking member 80 guides the air discharged from the ventilation hole 61*d* of the upper partition plate 61 into the blower chamber 10, and also prevents water droplets from entering the electrical component box 60 through the ventilation hole 61*d* of the upper partition plate 61, the water droplets resulting from the turning of the blower fans 20.

As illustrated in FIG. 11, the water blocking cover 81 is made of a steel plate, and a ventilation part 81*a* is formed on a surface thereof facing the blower chamber 10. A top face part 81*b* that is bent at a substantially right angle toward the electrical component box 60 is formed at the upper end of the ventilation part 81*a*. A bottom face part 81*c* that is bent at a substantially right angle toward the electrical component box 60 is formed at the lower end of the ventilation part 81*a*. A front side-face part 81*d* that is bent at a substantially right angle toward the electrical component box 60 is formed at the front-side side end of the ventilation part 81*a*. A back side-face part 81*e* that is bent at a substantially right angle toward the electrical component box 60 is formed at the back-side side end of the ventilation part 81*a*.

Figure 14:
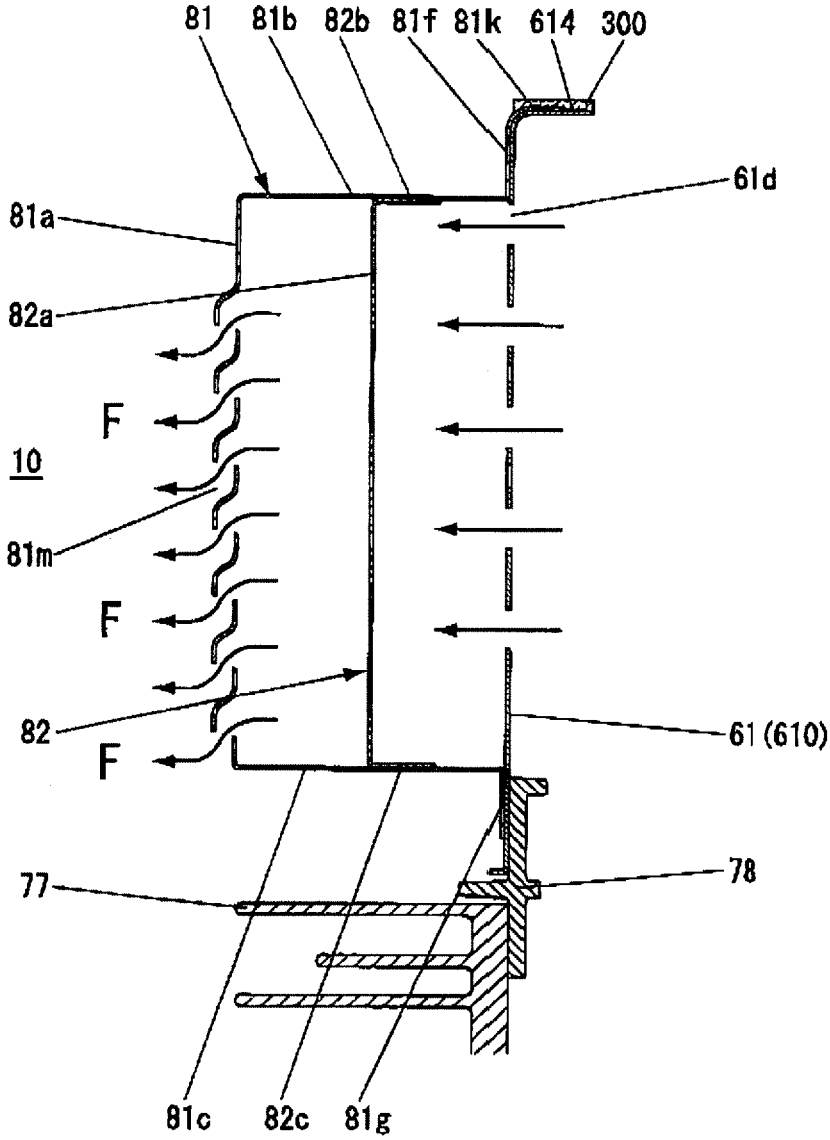
FIG. 14 is a cross-sectional view taken along a line Y-Y in FIG. 12 and is a view for describing flows of air from the electrical component box to the blower chamber.

As illustrated in FIG. 11 and FIG. 14, the ventilation part 81*a* is provided with a plurality of slit-like ventilation ports 81*m* with eaves, and as illustrated in FIG. 14, the ventilation ports 81*m* are opened downward with upper portions thereof being covered by the eaves.

As illustrated in FIG. 11, an upper bent part 81*f* that is bent upward at a substantially right angle is formed at the leading end of the top face part 81*b*. A flange 81*k* that is bent at a substantially right angle toward the electrical component box 60 is formed at the leading end of the upper bent part 81*f*. The top face part 81*b* is provided with an extending part 81*n* that is formed by extending part of the top face part 81*b* toward the back side so as to cover the upper end of the back side-face part 81*e*.

Figure 13:
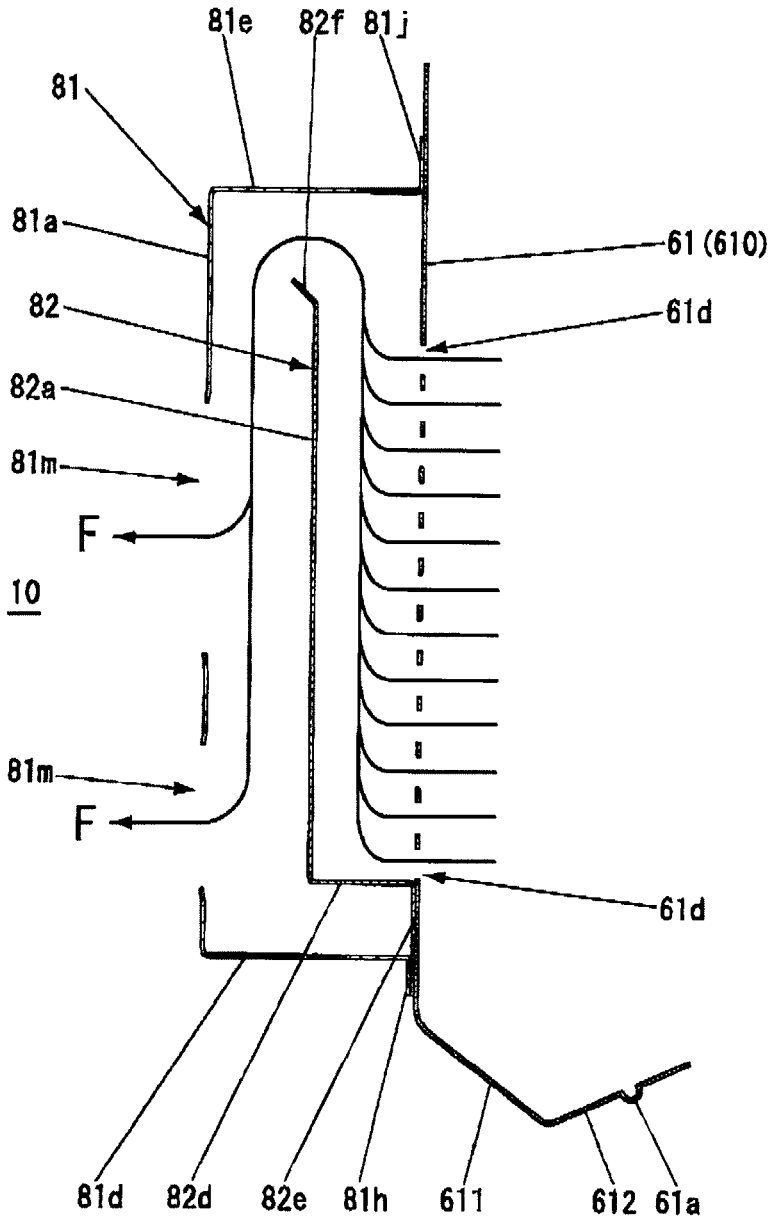
FIG. 13 is a cross-sectional view taken along a line X-X in FIG. 12 and is a view for describing flows of air from the electrical component box to a blower chamber.

As illustrated in FIG. 13 and FIG. 14, a front bent part 81*h* that is bent at a substantially right angle toward the front side is formed at the leading end of the front side-face part 81*d*. A back bent part 81*j* that is bent at a substantially right angle toward the back side is formed at the leading end of the back side-face part 81*e*. A lower bent part 81*g* that is bent downward at a substantially right angle is formed at the leading end of the bottom face part 81*c*.

As illustrated in FIG. 11, FIG. 13, and FIG. 14, the inner partition plate 82 is made of a steel plate, and an inner partition part 82*a* is formed on a plane substantially parallel to the ventilation part 81*a* of the water blocking cover 81 and the attachment part 610 of the upper partition plate 61. An upper bent part 82*b* that is bent at a substantially right angle toward the electrical component box 60 is formed at the upper end of the inner partition part 82*a*. A lower bent part 82*c* that is bent at a substantially right angle toward the electrical component box 60 is formed at the lower end of the inner partition part 82*a*. A side part 82*d* that is bent at a substantially right angle toward the electrical component box 60 is formed at the front-side side end of the inner partition part 82*a*. A side flange 82*e* that is bent at a substantially right angle toward the front side is formed at the leading end of the side part 82*d*. A bent part 82*f* bent toward the blower chamber 10 is formed at the back-side side end of the inner partition part 82*a*.

As illustrated in FIG. 13, the length of the inner partition part 82*a* in the front-back direction is smaller than the internal length of the water blocking cover 81 in the front-back direction (the distance between the inner surface of the front side-face part 81*d* and the inner surface of the back side-face part 81*e* of the water blocking cover 81). As illustrated in FIG. 14, the height of the inner partition plate 82 (the distance between the outer surface of the upper bent part 82*b* and the outer surface of the lower bent part 82*c*) is substantially the same as the internal length of the water blocking cover 81 in the top-bottom direction (the distance between the inner surface of the top face part 81*b* and the inner surface of the bottom face part 81*c* of the water blocking cover 81).

Figure 12:
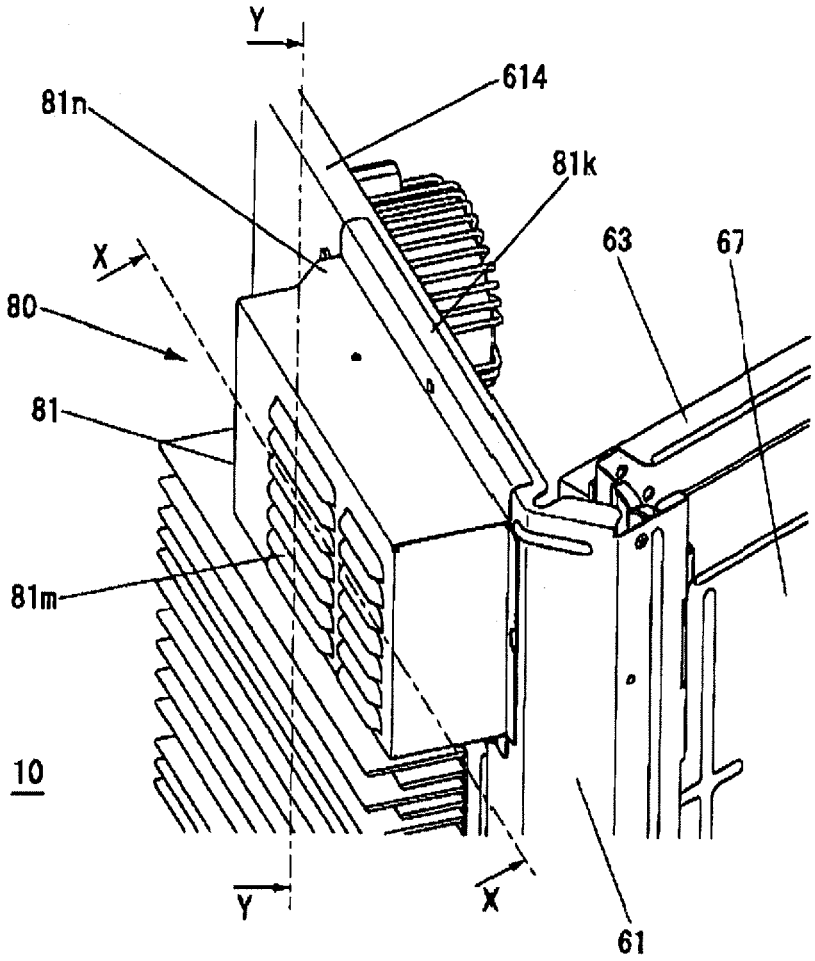
FIG. 12 is an enlarged view of a part D in FIG. 4.

As illustrated in FIG. 11, the inner partition plate 82 and the water blocking cover 81 are attached to the upper partition plate 61. The inner partition plate 82 is first welded to the attachment part 610 of the upper partition plate 61, and the water blocking cover 81 is then welded to the attachment part 610 of the upper partition plate 61. As illustrated in FIG. 12 and FIG. 14, at the time of welding the water blocking cover 81 to the upper partition plate 61, the flange 81*k* of the water blocking cover 81 is fitted to the upper flange 614 of the upper partition plate 61, whereby the positioning of the water blocking cover 81 is facilitated. Accordingly, the work of welding the water blocking cover 81 to the upper partition plate 61 can be simple, and the workability is enhanced. In addition, even if water droplets on the rear side of the top plate 1*n* fall onto the upper flange 614 of the upper partition plate 61, the flange 81*k* of the water blocking cover 81 can prevent the water droplets from entering the water blocking member 80. Eventually, the flange 81*k* can prevent the water droplets from entering the electrical component box 60. Note that, although steps are caused on the upper flange 614 by fitting the flange

81*k* of the water blocking cover 81 to the upper flange 614 of the upper partition plate 61, the seal material 300 is attached to the upper flange 614 as illustrated in FIG. 11, and the seal material 300 elastically deforms at the time of placing the top plate 1*n* thereon, to thereby absorb the steps on the upper flange 614, so that the inside of the structure is sealed.

Next, with reference to FIG. 13 and FIG. 14, description is given of a flow of air F (which is the same as the flow of discharged air F in FIG. 7A) that is suctioned from the inside of the electrical component box 60 through the ventilation hole 61*d* of the upper partition plate 61, passes around the inner partition plate 82, and is discharged into the blower chamber 10 from the ventilation ports 81*m* of the water blocking cover 81. As illustrated in FIG. 13, an inner portion of the water blocking member 80 on the front side of the outdoor unit 1 is blocked by the side part 82*d* and the side flange 82*e* of the inner partition plate 82. Similarly, as illustrated in FIG. 14, upper and lower inner portions of the water blocking member 80 are respectively blocked by the upper bent part 82*b* and the lower bent part 82*c* of the inner partition plate 82. In addition, space is formed between the back side-face part 81*e* of the water blocking cover 81 and the bent part 82*f* of the inner partition plate 82, in an inner portion of the water blocking member 80 on the back side of the outdoor unit 1. This space serves as the air flow passage. As indicated by arrows F in FIG. 13 and FIG. 14, the air that has been suctioned from the ventilation hole 61*d* of the upper partition plate 61 hits against the inner partition part 82*a* of the inner partition plate 82, and flows toward the air flow passage formed between the back side-face part 81*e* of the water blocking cover 81 and the bent part 82*f* of the inner partition plate 82. The air that has passed through the air flow passage and flown around the inner partition part 82*a* to reach the ventilation part 81*a* of the water blocking cover 81 is discharged into the blower chamber 10 from the ventilation ports 81*m* of the ventilation part 81*a*.

The front side-face part 81*d* and the back side-face part 81*e* of the water blocking cover 81 are formed by bending the respective side ends of the ventilation part 81*a*, and a slight gap may occur between the two side-face parts and the ventilation part 81*a*. As illustrated in FIG. 13, the air flow passage is formed between the back side-face part 81*e* of the water blocking cover 81 and the bent part 82*f* of the inner partition plate 82 in the back-side inner portion of the water blocking member 80, and hence this back-side inner portion is not blocked by the inner partition plate 82 unlike the other portions inside of the water blocking member 80. Accordingly, if water droplets are attached to the back side of the top face part 81*b* of the water blocking cover 81, the water droplets may enter the water blocking member 80 from the above-mentioned gap occurring between the back side-face part 81*e* and the ventilation part 81*a*. In order to prevent this, the extending part 81*n* that protrudes from the top face part 81*b* toward the back side of the outdoor unit 1 is provided so as to cover the gap occurring between the back side-face part 81*e* and the ventilation part 81*a*. The extending part 81*n* can prevent water droplets from entering the water blocking member 80 from the gap occurring between the back side-face part 81*e* and the ventilation part 81*a*, and eventually can prevent the water droplets from entering the electrical component box 60.

In the water blocking cover 81 described above, the extending part 81*n* is formed by extending part of the top face part 81*b* toward the back side. Alternatively, if the air flow passage is formed by the inner partition plate 82 in a front-side inner portion of the water blocking cover 81, the extending part 81*n* may be formed by extending part of the top face part 81*b* toward the front side. Still alternatively, if the air flow passage is formed by the inner partition plate 82 in a top-side inner portion of the water blocking cover 81, the extending part 81*n* may be formed by extending part of the top face part 81*b* toward both the front side and the back side.

Figure 15A:
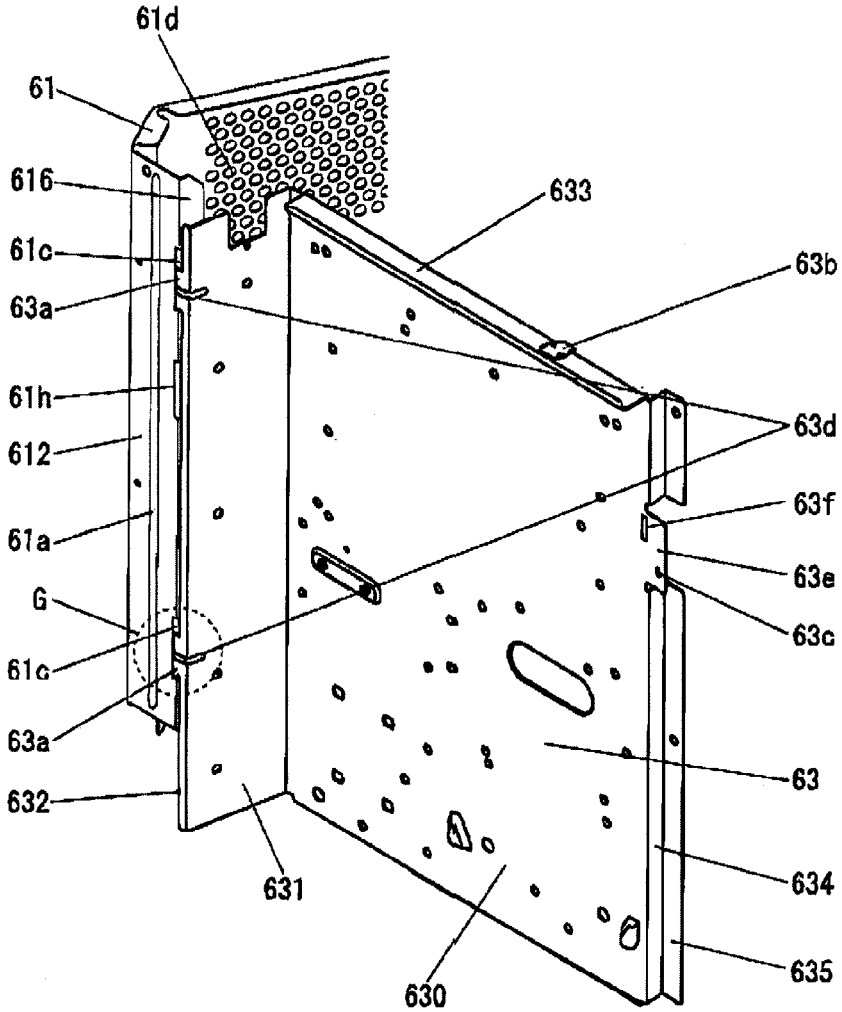
FIG. 15A is a perspective view for describing a state where the front plate is joined to the upper partition plate.
Figure 15B:
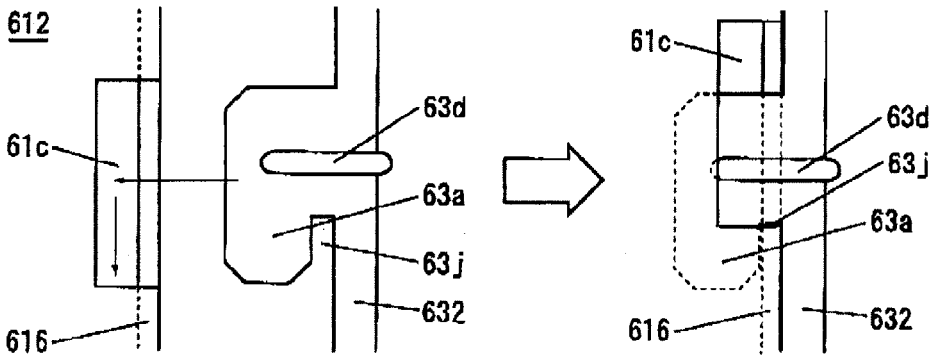
FIG. 15B is an explanatory view of a part G in FIG. 15A.

Next, with reference to FIG. 8 and FIG. 15 to FIG. 17, description is given of how to attach the front plate 63 and the front plate cover 67 to the upper partition plate 61 and effects thereof. Note that, in FIG. 8 and FIG. 15 to FIG. 17, the boards, components, and apparatuses attached to the front plate 63 and the upper partition plate 61 are omitted. As illustrated in FIG. 8 and FIG. 15, at the time of attaching the front plate 63 to the upper partition plate 61, first, the hinge pieces 63*a* provided on the left side of the front plate 63 are respectively engaged with the hinge slits 61*c* of the upper partition plate 61. As illustrated in FIG. 15B, first, each hinge piece 63*a* is inserted into each hinge slit 61*c* in the lateral direction of the hinge slit 61*c*. Next, the front plate 63 is slid downward, whereby an engagement part 63*j* of the hinge piece 63*a* is engaged with the front flange 616 of the upper partition plate 61. After that, as described with reference to FIG. 7A, the lower portion of the front plate 63 is screwed to the front side of the box base plate 62.

Figure 16:
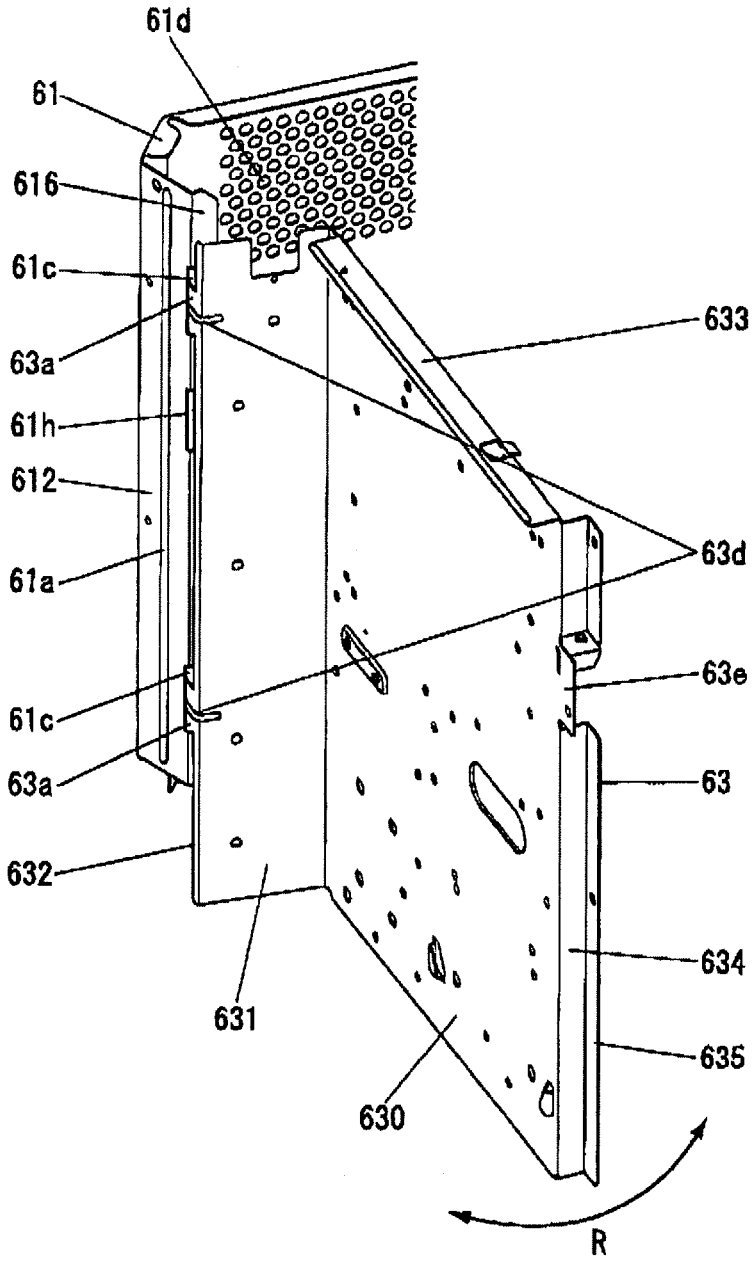
FIG. 16 is an explanatory view of a rotation state of the front plate.

The horizontal width of the hinge slit 61*c* of the upper partition plate 61 is set to be slightly larger (for example, 0.2 mm) than the thickness of the hinge piece 63*a* (the total value of the height of the bead 63*d* and the thickness of the hinge piece 63*a*). With such setting, as illustrated in FIG. 16, if the screw that fixes the front plate 63 to the box base plate 62 is removed, the front plate 63 can be rotated in a direction indicated by an arrow R with respect to the insertion parts of the hinge pieces 63*a* into the hinge slits 61*c*.

At the time of replacing or repairing the boards, components, and apparatuses in the electrical component box 60 during maintenance work of the outdoor unit 1, a worker detaches the service panel 1*m* of the outdoor unit 1, and removes the screw that fixes the front plate 63 to the box base plate 62. Then, the worker detaches the front plate cover 67, and rotates the front plate 63 toward the near side, whereby the worker can perform internal work of the electrical component box 60. Accordingly, the workability during maintenance is enhanced.

Figure 17:
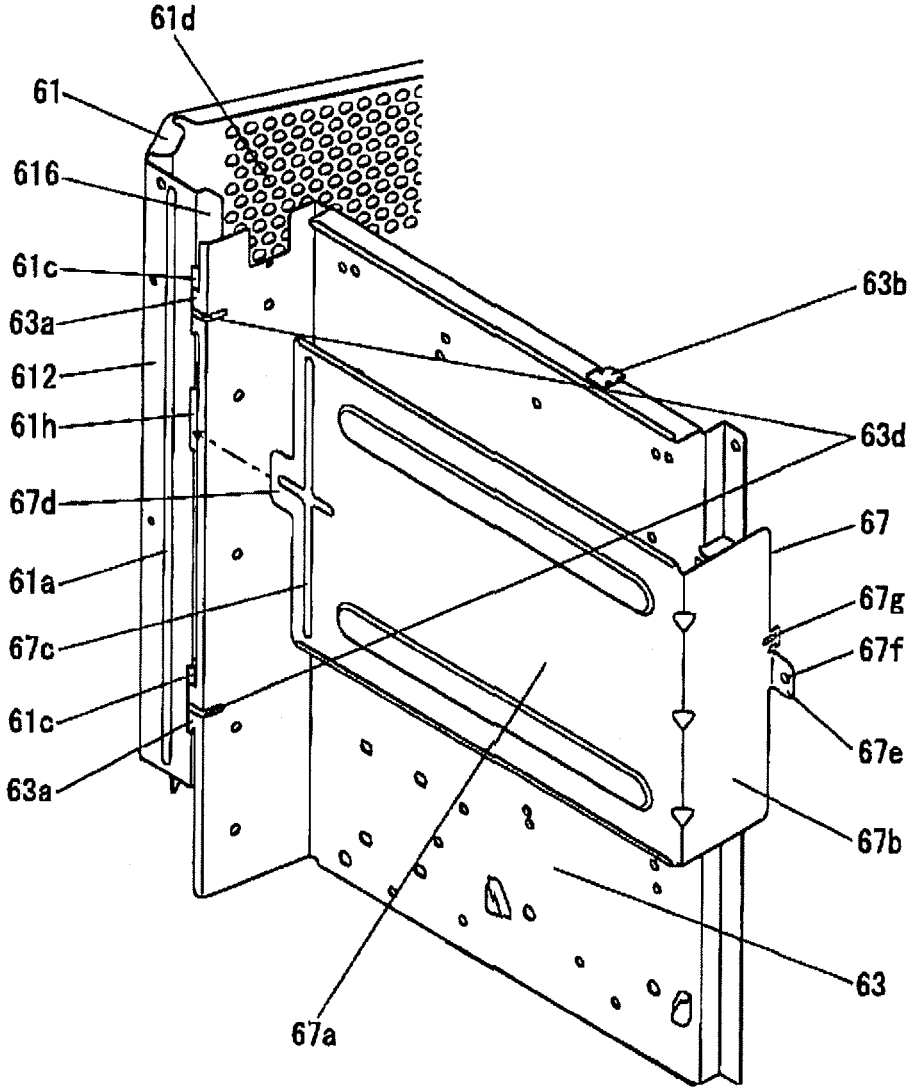
FIG. 17 is an explanatory view for joining the front plate cover to the upper partition plate.

As illustrated in FIG. 17, after the front plate 63 is attached to the upper partition plate 61 and the box base plate 62, the front plate cover 67 is attached to the upper partition plate 61 and the front plate 63. The first insertion piece 67*d* of the front plate cover 67 is inserted into the insertion piece slit 61*h* of the upper partition plate 61. After that, the fixing piece 67*e* of the front plate cover 67 is brought into contact with the fixing part 63*e* of the front plate 63, and the screw hole 67*f* of the front plate cover 67 is fixed with the screw to the screw hole 63*c* of the front plate 63.

In the front part 67*a* of the front plate cover 67, the length between the insertion piece 67*d* and the upper end part of the front part 67*a* and the length of the front part 67*a* in the left-right direction are set such that the rear surface of an upper left portion of the front part 67*a* covers part of the bead 63*d* provided on the upper hinge piece 63*a* of the front plate 63 when the front plate cover 67 is attached to the upper partition plate 61 and the front plate 63. Accordingly, when the first insertion piece 67*d* of the front plate cover 67 is inserted into the insertion piece slit 61*h* of the front plate 63, (the rear surface of the upper left portion of) the front part 67*a* of the front plate cover 67 comes into contact with (runs on) the bead 63*d* of the upper hinge piece 63*a*. At this time, the length and the thickness (the total value of the height of the bead 67*c* and the thickness of the first insertion piece 67*d*) of the first insertion piece 67*d* are determined such that the bead

67*c* of the first insertion piece 67*d* comes into contact with the rear surface of the second front bent part 612 of the upper partition plate 61. Accordingly, when the front plate cover 67 is attached to the upper partition plate 61 and the front plate 63, the bead 67*c* of the first insertion piece 67*d* comes into contact with the rear surface of the second front bent part 612 of the upper partition plate 61, and the front part 67*a* comes into contact with the bead 63*d* provided on the upper hinge piece 63*a* of the front plate 63, whereby the front plate 63 and the front plate cover 67 push each other. Note that, in such an attachment state of the front plate cover 67 as described above, the upper-end left side (the portion in contact with the bead 63*d*) of the front part 67*a* of the front plate cover 67 may warp toward the front side, but the bead 67*c* is provided also in the top-bottom direction on the front part 67*a*, and hence the warpage of the upper-end left side of the front part 67*a* can be suppressed.

Because the horizontal width of each hinge slit 61*c* of the upper partition plate 61 is set to be slightly larger than the thickness of each hinge piece 63*a* of the front plate 63, a slight gap exists between the hinge slit 61*c* and the hinge piece 63*a*. In the case where the front plate 63 and the upper partition plate 61 vibrate due to vibration of the compressor provided in the machinery chamber 11 during the operation of the outdoor unit 1, the hinge slits 61*c* and the hinge pieces 63*a* may hit against each other due to the vibration to thereby cause noise (hitting sound). In order to solve this, the front plate cover 67 is attached to the front plate 63, whereby the front plate 63 and the front plate cover 67 push each other. Hence, even if the front plate 63 and the upper partition plate 61 vibrate, the hinge slits 61*c* and the hinge pieces 63*a* do not hit against each other, and the noise caused by the hitting can be suppressed from occurring. In addition, because the front plate cover 67 is pushed by the front plate 63, the front plate cover 67 can be suppressed from vibrating.

The invention claimed is:

1. An outdoor unit of an air conditioner, comprising:

a housing comprising a front panel, a back panel, a top plate, a service panel and a bottom plate, wherein an inside of the housing is divided by a partition plate extending between the bottom plate and the top plate, into a blower chamber housing therein at least a heat exchanger and a blower fan, and a mechanical chamber housing therein at least a compressor and an electrical component box, the compressor is disposed at a lower part of the mechanical chamber, the electrical component box is disposed at an upper part of the mechanical chamber, the partition plate comprises an upper partition plate partitioning the upper part of the mechanical chamber from the blower chamber and a lower partition plate partitioning the lower part of the mechanical chamber from the blower chamber, the electrical component box comprises the upper partition plate, a front plate disposed along an inner surface of the service panel, said service panel covers a front side of the electrical component box, and a box base plate that receives a lower end part of the upper partition plate, said box base plate receives a lower portion of the front plate and said box base plate is fixed to an upper end surface of the lower partition plate, the box base plate is provided with a flange in a periphery of said box base plate, the flange extending downwardly, a part of the flange has a corresponding shape to the upper end surface of the lower partition plate and is received on the upper end surface of the lower partition plate, and the electrical component box is set in the mechanical chamber and the part of the flange is fitted to the lower partition plate.

2. The outdoor unit of an air conditioner according to claim 1, wherein the lower partition plate includes a receiving part, said receiving part is bent inwardly extending towards an inner side of the mechanical chamber, formed on the upper end surface thereof, the receiving part receiving the box base plate.

3. The outdoor unit of an air conditioner according to claim 2, wherein the box base plate has a cut-out part cutting out a part of the flange, and an end of the receiving part engages with the cut-out part.

4. The outdoor unit of an air conditioner according to claim 3, wherein the lower partition plate has a vertical flange extending from a vertical end of the lower partition plate, orthogonally to a vertical direction of the lower partition plate and outwardly away from the box base plate, and an upper end of the vertical flange fits into the cut-out part.

5. The outdoor unit of an air conditioner according to claim 4, further comprising an L-shaped arm including a bent part having a circular arc shape, and a support post fixed between the arm and the box base plate, wherein the arm has one end that abuts at a right angle against a rear surface of the front plate and another end coupled to a rear surface of the upper partition plate, and the support post is fixed perpendicularly to the arm and the box base plate and connects the arm and the box base plate in a vertical direction.

6. The outdoor unit of an air conditioner according to claim 5, wherein the arm comprises an abutment surface fixed to the rear surface of the front plate.

* * * * *